US006011355A

United States Patent [19]

Nagai

[11] Patent Number: 6,011,355

[45] Date of Patent: Jan. 4, 2000

[54] PLASMA DISPLAY DEVICE AND METHOD OF DRIVING PLASMA DISPLAY PANEL

[75] Inventor: Takayoshi Nagai, Tokyo, Japan

[73] Assignee: Mitsubishi Denki Kabushiki Kaisha, Tokyo, Japan

[21] Appl. No.: 09/090,262

[22] Filed: Jun. 4, 1998

[30] Foreign Application Priority Data

Jul. 16, 1997 [JP] Japan ..... P09-191641
Mar. 17, 1998 [JP] Japan ..... P10-066986

[51] Int. Cl.[7] ..... G09G 3/28

[52] U.S. Cl. ..... 315/167.3; 315/169.4; 345/60; 345/78

[58] Field of Search ..... 315/169.4, 169.3, 315/169.2, 169.1; 345/51, 55, 78, 60

[56] References Cited

U.S. PATENT DOCUMENTS 5,721,559 2/1998 Nagakubo ..... 345/63
5,786,794 7/1998 Kishi et al. ..... 345/60

FOREIGN PATENT DOCUMENTS 0-704834A1 3/1996 European Pat. Off. .
5-265397 10/1993 Japan .

*Primary Examiner*—David H. Vu
*Assistant Examiner*—Wilson Lee

[57] ABSTRACT

A plasma display device which is capable of solving the problem of a trade-off between the increase in recovery efficiency of reactive power resulting from charging and discharging of a plasma display panel serving as a capacitive load and the adverse effects upon a gas discharge characteristic in the plasma display panel is provided. First and second sustain pulses are applied respectively to first and second electrodes (X, Y1-Yn) arranged in parallel in pairs for respective display lines so that the output time periods of the first and second sustain pulses partially overlap each other on the time axis. One of the first and second sustain pulses which rises earlier has a higher rate of voltage change at the rising and falling edges than does the other.

12 Claims, 30 Drawing Sheets

124
Aj

Vcc
123b
p2
122
Y1

123b
Y2

123b
122
Yn

Vcc
123a
p1
121
X

Vcc
Yi
V1
0
$\pi\sqrt{L_Y C_P}$
$\pi\sqrt{L_Y C_P}$
p2

Vcc
X
V1
0
$\pi\sqrt{L_X C_P}$
$\pi\sqrt{L_X C_P}$
p1

+Vcc
Yi − X
0
−Vcc

LUMINESCENCE $t_{op}$
GAS DISCHARGE
GAS DISCHARGE
time
t
$t_{f1}$ $t_{f2}$ $t_{f3}$ $t_{f4}$ $t_{f5}$ $t_{f6}$ $t_{f7}$ V34a
L(OFF)
H(ON)
$\pi\sqrt{L_Y C_P}$

V38
L(OFF)
H(ON)

V34b
L
(OFF)
H(ON)
$\pi\sqrt{L_Y C_P}$

V39
L
(OFF)
H(ON)

V22a
L
(OFF)
H(ON)

V26
L
(OFF)
H(ON)
$\pi\sqrt{L_X C_P}$ time
$t_{f1}$
$t_{f2}$
$t_{f3}$
$t_{f4}$
$t_{f5}$ FIG. 7(a) A
FIG. 7(b) Y1
FIG. 7(c) Y2
FIG. 7(d) Yn
FIG. 7(e) X
124
123b
123a
122
121
$t_{ST}$
$t_{ED}$
PRIMING OPERATION
ADDRESS OPERATION
SUSTAIN OPERATION
WALL CHARGE POLARITY ADJUSTING OPERATION V34a
L(OFF)
H(ON)

V38
L(OFF)
H(ON)

V34b
L
(OFF)
H(ON)

V39
L
(OFF)
H(ON)

V22a, V26
V22b
L
L(OFF)
L(OFF)

V28
H
H(ON)
H(ON)

time
$t_{ST}$
$t_{ED}$

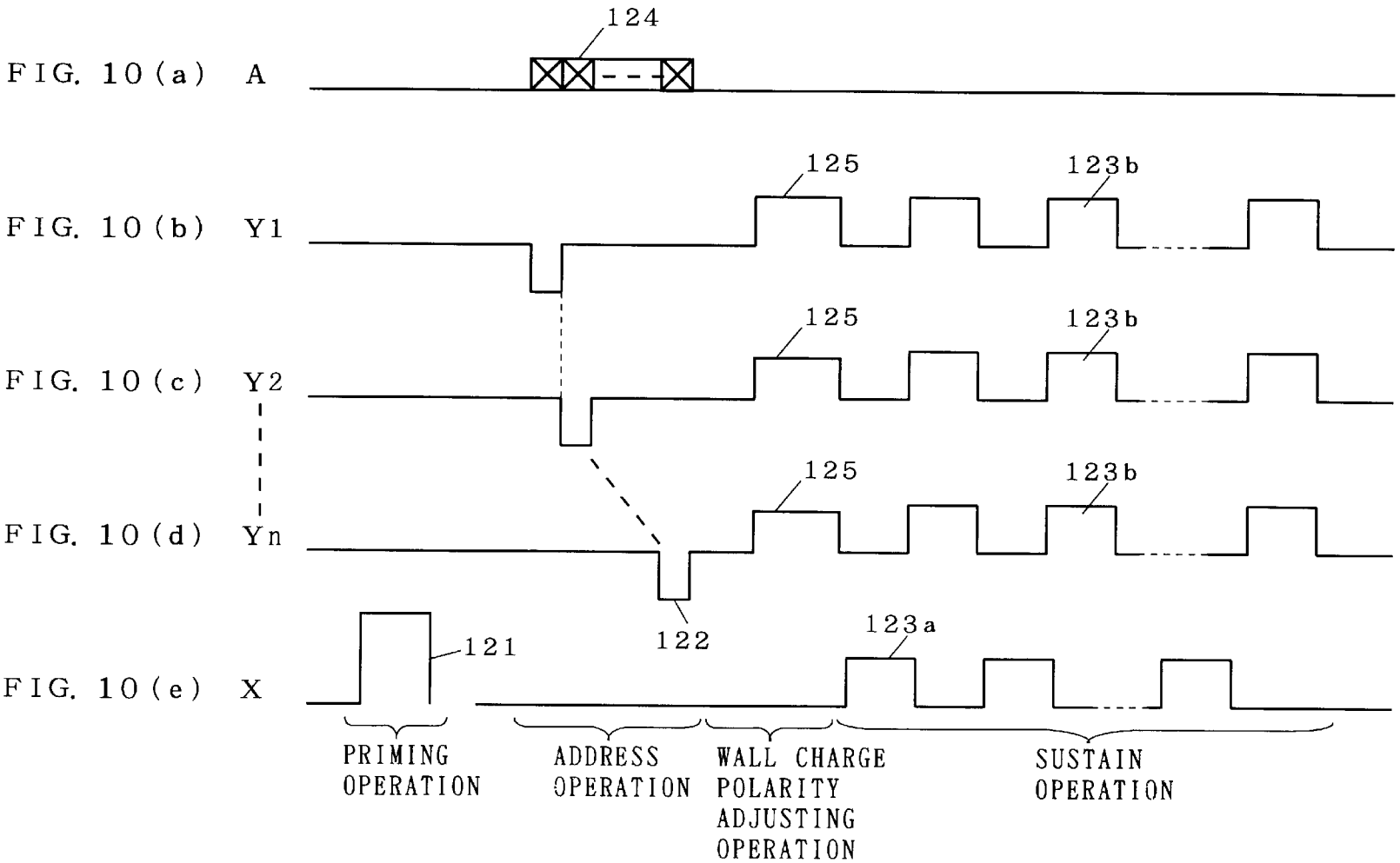
FIG. 10(a) A
124
FIG. 10(b) Y1
125
123b
FIG. 10(c) Y2
125
123b
FIG. 10(d) Yn
125
123b
122
FIG. 10(e) X
121
123a
PRIMING OPERATION
ADDRESS OPERATION
WALL CHARGE POLARITY ADJUSTING OPERATION
SUSTAIN OPERATION

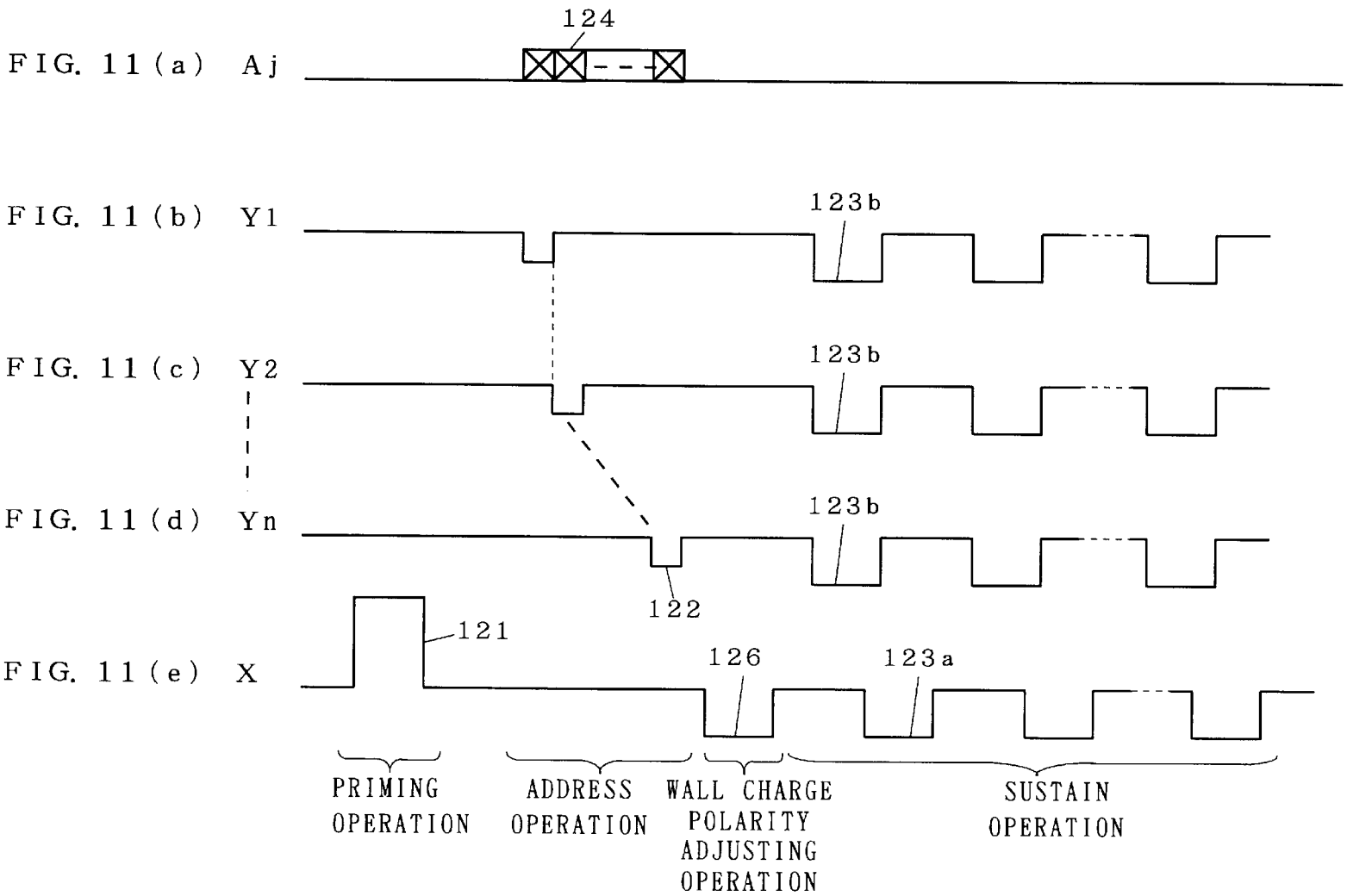
FIG. 11(a) Aj
FIG. 11(b) Y1
FIG. 11(c) Y2
FIG. 11(d) Yn
FIG. 11(e) X
124
123b
123b
123b
122
121
126
123a
PRIMING OPERATION
ADDRESS OPERATION
WALL CHARGE POLARITY ADJUSTING OPERATION
SUSTAIN OPERATION

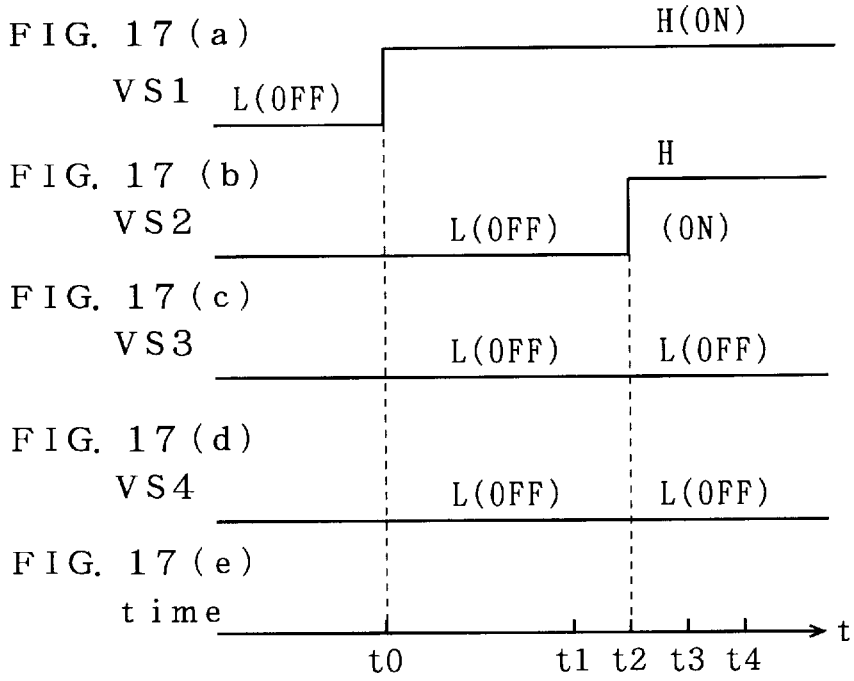
FIG. 17(a)
VS1
L(OFF)
H(ON)
FIG. 17(b)
VS2
L(OFF)
H
(ON)
FIG. 17(c)
VS3
L(OFF)
L(OFF)
FIG. 17(d)
VS4
L(OFF)
L(OFF)
FIG. 17(e)
time
t0
t1
t2
t3
t4
t
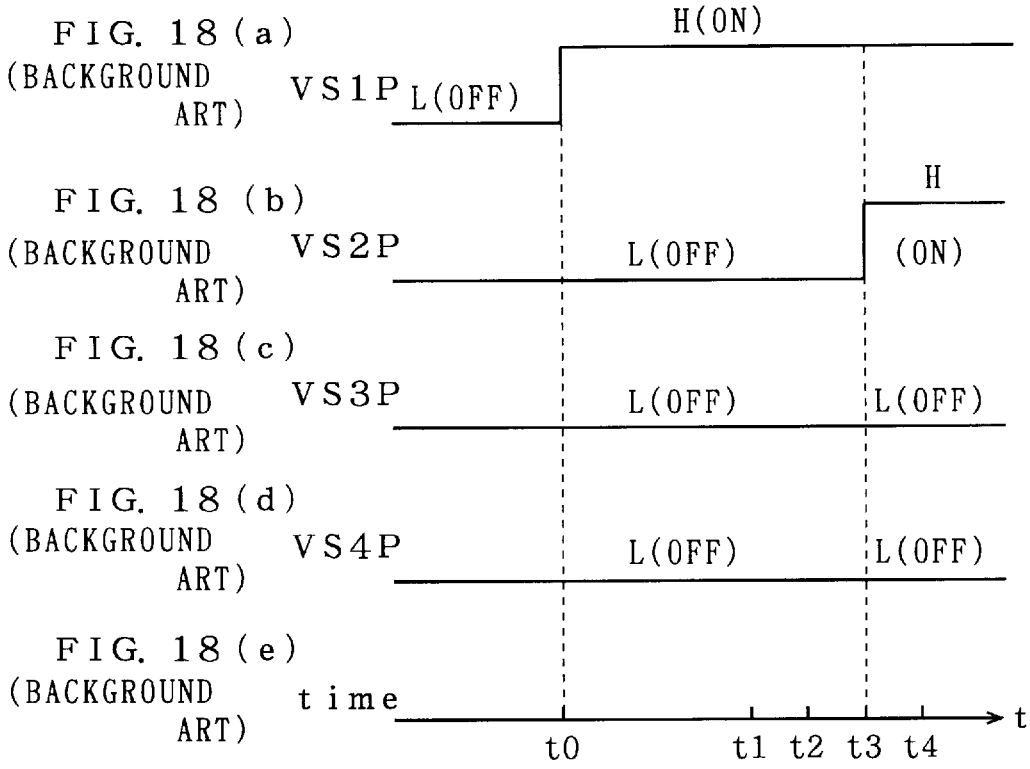
FIG. 18(a)
(BACKGROUND ART)
VS1P
L(OFF)
H(ON)
FIG. 18(b)
(BACKGROUND ART)
VS2P
L(OFF)
H
(ON)
FIG. 18(c)
(BACKGROUND ART)
VS3P
L(OFF)
L(OFF)
FIG. 18(d)
(BACKGROUND ART)
VS4P
L(OFF)
L(OFF)
FIG. 18(e)
(BACKGROUND ART)
time
t0
t1
t2
t3
t4
t

VS1
L(OFF)
H
(ON)
L

VS3, VS6
L(OFF)
H
(ON)
L

VS2
L
L(OFF)
H
(ON)

VS4, VS5
L
L(OFF)
H
(ON)

time
t
t0
t1
t2
t3
t4
t5

FIG. 29 ($a_0$) (BACKGROUND ART)
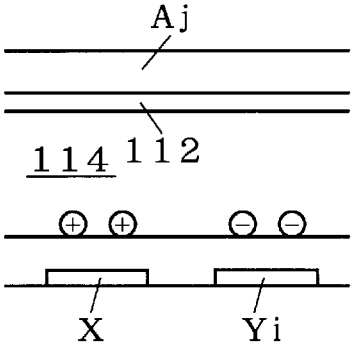
FIG. 29 ($b_0$) (BACKGROUND ART)
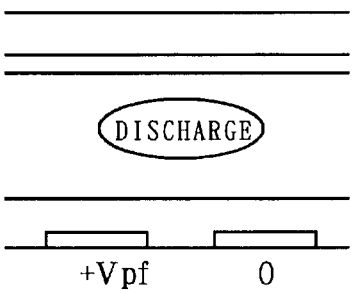
FIG. 29 ($c_0$) (BACKGROUND ART)
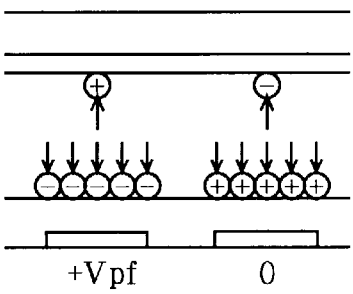
FIG. 29 ($d_0$) (BACKGROUND ART)
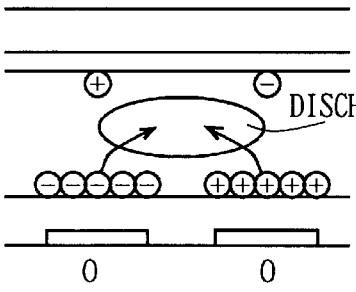
FIG. 29 ($e_0$) (BACKGROUND ART)
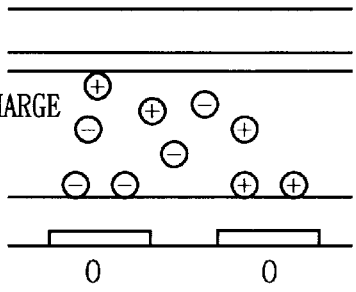
FIG. 29 ($f_0$) (BACKGROUND ART)
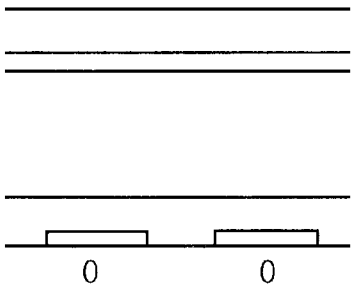

FIG. 30 (PRIOR ART)
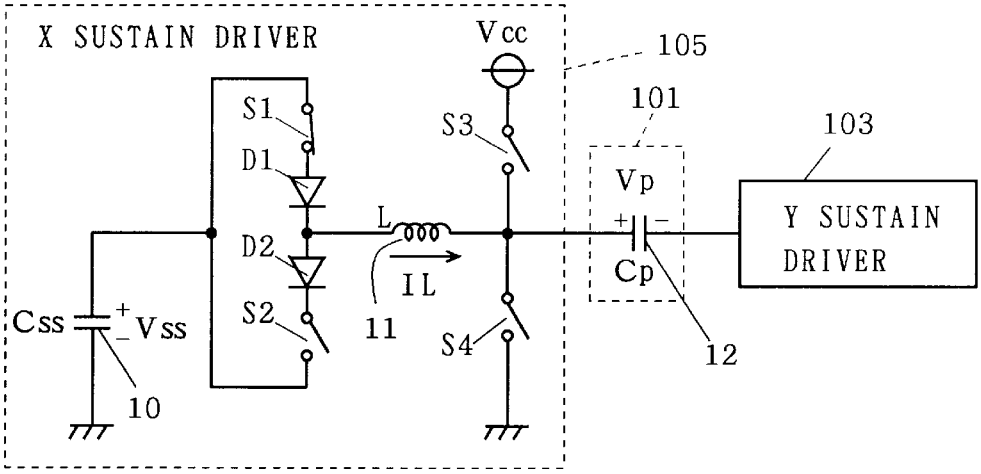
FIG. 31 (a) (PRIOR ART)
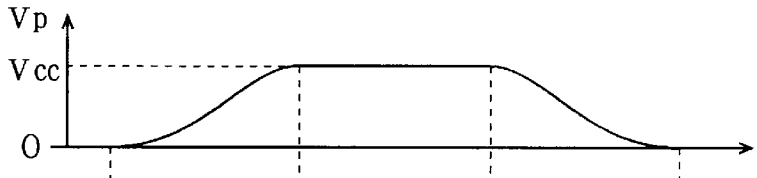
FIG. 31 (b) (PRIOR ART)
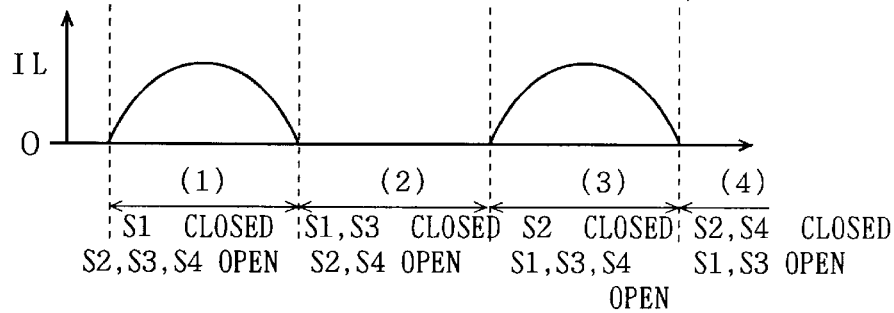

FIG. 35 (a)
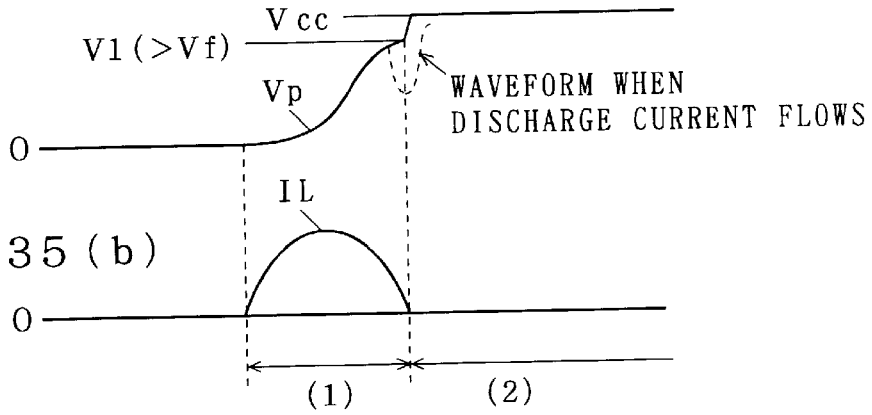
FIG. 35 (b)
FIG. 36
(BACKGROUND ART)
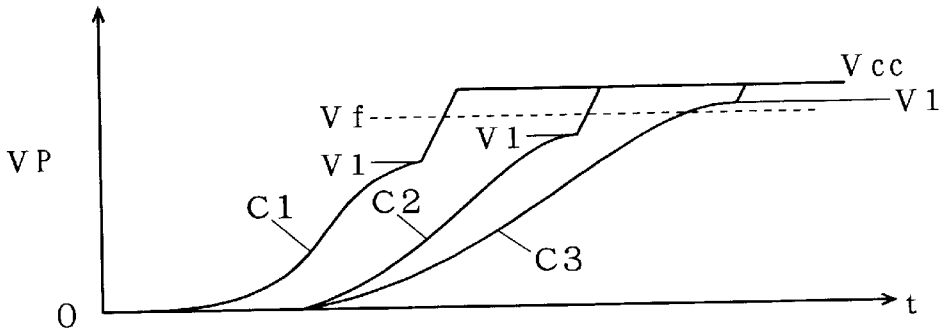

PLASMA DISPLAY DEVICE AND METHOD OF DRIVING PLASMA DISPLAY PANEL

BACKGROUND OF THE INVENTION

1. Field of the Invention

The present invention relates to a method of and device for driving a plasma display panel including cells defined at respective points of intersection of a plurality of electrodes.

2. Description of the Background Art

FIG. 26 is a schematic diagram of a plasma display device disclosed in, for example, U.S. Pat. No. 5,446,344 (8/1995) (first prior art). The reference numeral 101 designates a display panel which comprises a first glass substrate serving as a first substrate, sustain electrodes X as first electrodes and scan electrodes Y1 to Yn as second electrodes which are formed on the first glass substrate and arranged in parallel, a second glass substrate opposed to the first glass substrate and serving as a second substrate, and address electrodes A1 to Am as third electrodes which are formed on the second glass substrate and arranged in a direction perpendicular to the sustain electrodes X and the scan electrodes Y1 to Yn.

The plasma display device includes n×m pixels. A discharge cell is defined at a point of intersection of any scan electrode Yi (i=1 to n) and any address electrode Aj (j=1 to m). The scan electrodes Y1 to Yn and the address electrodes A1 to Am are insulated from and independent of each other for individual drive so that address selection for switching on/off is made for each of the defined discharge cells.

The sustain electrodes X are paired with the scan electrodes Y1 to Yn respectively, and have respective first ends connected commonly. Voltages in the form of pulses of first to fourth voltages to be applied to these electrodes are generated in a power supply circuit 102 and supplied to the electrodes through a Y sustain driver 103, a scan driver 104, an X sustain driver 105, and an address driver 106. The Y sustain driver 103, the scan driver 104, the X sustain driver 105, and the address driver 106 are controlled by respective control signals from a control circuit 107. The control circuit 107 generates the control signals based on display data (DATA in FIG. 26) supplied from the exterior, a dot clock (CLK in FIG. 26) in synchronism with the display data, a vertical synchronizing signal (VSYNC in FIG. 26), and a horizontal synchronizing signal (HSYNC in FIG. 26).

FIG. 27 is a sectional view of a cell of a plasma display panel. In FIG. 27, the reference characters X and Yi designate a pair of sustain and scan electrodes formed on a glass substrate 108 serving as the first substrate and extending in the direction perpendicular to the plane of the figure; 109 designates a dielectric layer (for holding a wall charge) formed on the pair of sustain and scan electrodes X and Yi; 110 designates a protective layer formed on the surface of the dielectric layer 109; Aj designates an address electrode formed on a glass substrate 111 as the second substrate opposed to the glass substrate 108, and extending in the lateral direction of the plane of the figure; 112 designates a phosphor formed on the address electrode Aj; 113 designates barrier ribs formed on the boundaries of pixels; and 114 designates a discharge space between the protective layer 110 and the phosphor 112 which is filled with a Penning gas mixture of neon ion ($Ne^+$) and xenon, for example.

Operation is described hereinafter.

FIGS. 28(*a*) through 28(*f*) illustrate applied voltage waveforms showing a conventional method of driving a plasma display device. In FIGS. 28(*a*) through 28(*f*), a reset step, a write step, and a sustain discharge step are shown in chronological order.

Referring to FIGS. 28(*a*) through 28(*f*), in the reset step, a priming pulse 121 serving as a pulse of the first voltage is applied between the sustain electrode X and the scan electrode Yi to produce a gas discharge between the sustain electrode X and the scan electrode Yi, thereby generating a space charge in the discharge space 114 and accumulating a wall charge which allows a wall voltage higher than a firing voltage to be generated. Next, a self-erase discharge is caused to occur at the falling edge of the priming pulse 121 to place the cell into a charge erased condition (wherein the accumulated charge in the dielectric layer 109 on the sustain electrode X and the scan electrode Yi equals zero).

Next, in the write step, a scan pulse 122 is applied sequentially to the scan electrodes Y1 to Yn, and address pulses are applied to the address electrodes A1 to Am in accordance with the display data, whereby the second voltage is developed between the address electrodes A1 to Am and the scan electrodes Y1 to Yn to initiate a write discharge.

Then, in the sustain discharge step, a sustain pulse is alternately applied between the sustain electrode X and the scan electrode Yi (the fourth voltage is alternately applied between the sustain electrode X and the scan electrode Yi) to maintain the gas discharge.

The first voltage used herein is a potential difference between the sustain electrode X and the scan electrode Yi. In FIGS. 28(*b*) through 28(*e*), the scan electrode Yi is at zero potential, and a pulse at a potential Vpf is applied to the sustain electrode X. Therefore, the potential Vpf equals the first voltage. Alternatively, a pulse at a potential Vp α and a pulse at a negative potential Vp β (where (first voltage)=Vp α−Vp β), for example, may be applied to the sustain electrode X and the scan electrode, respectively, as will be described later.

Similarly, the second voltage is a potential difference between the address electrode Aj and the scan electrode Yi. (In FIGS. 28(*a*) through 28(*f*), Va−Vsp=(second voltage). This may be expressed as |Va|+|Vsp|=(second voltage) since the potential Vsp is a negative potential.)

The fourth voltage is a potential difference between the sustain electrode X and the scan electrode Yi (Vcc=(fourth voltage) in FIGS. 28(*b*) through 28(*e*)).

The above described reset step, write step, and sustain discharge step are sequentially repeated for display operation.

With reference to FIGS. 29($a_0$) through 29($f_0$), state changes within a cell in the reset step are described below. FIGS. 29(*f*) through 29($f_0$) correspond to time periods (a) to (f) shown in FIG. 28(*f*), respectively. After the end of the preceding drive cycle, predetermined amounts of wall charges having opposite polarities are accumulated in portions corresponding to the sustain electrode X and the scan electrode Yi which are adjacent to each other, respectively (FIG. 29($a_0$)). In this state, when the priming pulse 121 is applied between the sustain electrode X and the scan electrode Yi, a gas discharge is initiated between the sustain electrode X and the scan electrode Yi (FIG. 29($b_0$)). Electrons and positive ions generated by the gas discharge are attracted toward the opposite-polarity sustain electrode X and scan electrode Yi respectively and accumulated on the surface of the dielectric layer 109 to act as respective wall charges associated with the sustain electrode X and scan electrode Yi. Since these wall charges reduce the electric field strength in the discharge space, the gas discharge immediately converges to a termination (FIG. 29($c_0$)).

Next, when the application of the priming pulse 121 to the sustain electrode X and the scan electrode Yi is stopped, the wall charges initiate a gas discharge between the sustain electrode X and the scan electrode Yi (FIG. 29($d_0$)). Then, the positive ions and the electrons recombine together (FIG. 29($e_0$)), resulting in the reduction in wall charges (FIG. 29($f_0$)).

In the reset step, the priming pulse 121 (entire write pulse) applied between the sustain electrode X and the scan electrode Yi performs the following functions:

(a) To force a gas discharge to occur once to reset the charges into a relatively uniform state independently of the previous display state.

(b) To generate a space charge to render a subsequent gas discharge easy to occur.

(c) To cause an erase operation (to return all discharge cells into an erase state, that is, a state wherein there is no accumulated charge).

The PDP (plasma display panel) is a capacitive load in structural terms. When the sustain pulse is applied to the load, a reactive power is generated by charging and discharging a capacitance element of the panel (refereed to hereinafter as a panel capacitance). U.S. Pat. No. 5,081,400 (1/1992) as a second prior art technique discloses a sustain pulse generating circuit as shown in FIG. 30 (illustrating an X sustain driver connected to a sustain electrode X and a Y sustain driver connected to a scan electrode Yi) which comprises a capacitor 10 and an inductor 11 for recovery of the reactive power by utilizing the LC resonance of a panel capacitance 12 and the inductor 11.

Next, how the circuit shown in FIG. 30 operates will be described with reference to FIGS. 31(*a*) and 31(*b*).

State (1)

Initially, switch elements S2, S3 and S4 are opened, and a switch element S1 is closed. Then, a charging current flows from the capacitor 10 charged up to a voltage Vss through the inductor 11 to the static capacitance element 12 of the display panel 101. At this time, the inductor 11 and the static capacitance element 12 form a series resonant LC circuit, and a panel voltage Vp rises up to a voltage expressed by 2×Vss. Since Vss=Vcc/2, the panel voltage Vp rises up to a power supply voltage Vcc which is a sustain pulse voltage. At this point of time, current $I_L$ flowing through the inductor 11 equals zero.

It should be noted that the panel voltage Vp means a potential difference between the electrodes X and Yi, that is, a voltage applied to the display panel at a certain instant. Therefore, the panel voltage Vp is expressed as a function of time t in the form of Vp(t).

State (2)

The switch element S3 is closed to hold the panel voltage Vp at the power supply voltage Vcc. A gas discharge current is fed through the switch element S3 to the display panel.

State (3)

The switch elements S1 and S3 are opened, and the switch element S2 is closed. The inductor 11 and the static capacitance element 12 again form a series resonant circuit, and the panel voltage Vp drops to a ground level. At this point of time, the current $I_L$ equals zero.

State (4)

The switch element S4 is closed to hold the panel voltage Vp at the ground level.

Subsequently, the driver (Y sustain driver) which is provided on the opposite side of the panel from the X sustain driver in a symmetrical manner performs similar operations in States (1) to (4).

In the above described operations, the switch elements S3 and S4 function to clamp and hold the panel voltage Vp at the power supply voltage Vcc or the ground level. Accordingly, the switch elements S3 and S4 are referred to hereinafter as clamp switches.

This prior art structure is characterized in that when the current $I_L$ flowing through the inductor 11 reaches zero, the clamp switch S3 or S4 is switched on to hold the panel voltage Vp at the power supply voltage Vcc or the ground level. Specifically, the panel voltage Vp is at a maximum level (or a minimum level) when the current $I_L$ flowing through the inductor 11 reaches zero. At this point of time, the clamp switch S3 or S4 is switched on to maximize the efficiency of power recovery (ideally 100%). An ideal operation without power losses is described above. FIG. 32 is an equivalent diagram of a practical plasma display panel and circuit for driving the same. Power losses in resistance elements R1, Rd1, R2, Rd2, $R_L$ in the circuit and some losses resulting from the presence of additional static capacitance elements c1, c2, cd1, cd2 which do not contribute to the recovery are caused.

Most of the losses in the plasma display device are caused in the resistance elements. FIG. 33 is an equivalent diagram of a series resonant LCR circuit which may be considered by significant simplification of the plasma display panel and circuit for driving the same shown in FIG. 32. In this case, the increase in power losses may be treated as the decrease in Q-value in the series resonant LCR circuit.

As a result, an output voltage does not reach the power supply voltage Vcc only by charging the panel capacitance element using the LC series resonance discussed in State (1), that is, by charging caused by the transfer of energy accumulated in the inductor 11. As shown in FIGS. 34(*a*) and 34(*b*), the panel voltage Vp exhibits two-step changes: the series resonant LC circuit causes the panel voltage Vp to once reach a voltage V1 determined by the Q-value thereof, and controlling the switch element S3 to be in the on state at this time causes the panel voltage Vp to reach the voltage Vcc.

The reactive power recovery efficiency in the above described circuit shown in FIG. 33, that is, the proportion of the recovered power to the reactive power caused by the panel capacitance 12 is expressed approximately as V1/Vcc.

This is explained using expressions to be described below. The reactive power P0 caused by the panel capacitance 12 having a capacitance value Cp is expressed as $$P0=f\times Cp\times Vcc^2$$

where f is the frequency of charging and discharging per unit time, and the power P1 supplied from the power supply is expressed as $$P1=\int(Vcc\times i(t))\,dt=Vcc\times f\times Cp\times(Vcc-V1)$$

Thus, the reactive power recovery efficiency is expressed as $$1-P1/PO=V1/Vcc$$

The increase in reactive power recovery efficiency in the above described circuitry requires the increase in the Q-value of the resonant LC circuit. For the increase in the Q-value of the resonant LC circuit, any one of the following requirements should be satisfied:

(a) To set the inductance L of the inductor 11 to a level higher than the conventional inductance.

(b) To decrease the value Cp of the panel capacitance 12.

(c) To decrease the resistance element.

For the requirement (b), the value Cp of the panel capacitance 12 is determined by, the plasma display panel acting as the load and, thus, very difficult to decrease.

For the requirement (c), the resistance element is determined by the resistances of the components to be used and the resistances of the electrodes in the plasma display panel, and the decrease in the resistance element leads to a significant increase in costs.

For the requirement (a), setting the inductance to a relatively high level is very effective in practical terms. However, the setting of the inductance to a relatively high level to increase the Q-value of the resonant LC circuit in the case where the circuit of FIG. 33 is used for a plasma display device presents another problem that is adverse effects upon the gas discharge as will be described later.

The above-mentioned problem is described below with reference to FIGS. 35(*a*) and 35(*b*).

As illustrated in State (1), the panel voltage Vp rises up to the voltage to be reached (first level) V1 which is determined in accordance with the setting of the Q-value of the resonant LC circuit. At this time, if the first level V1 exceeds a firing voltage Vf and a rise time greater than a discharge delay time is required, a gas discharge is initiated on the panel before the transition to State (2). During the time represented by State (1), current is supplied through the inductor 11 in the resonant LC circuit to the plasma display panel, providing a very high output impedance in principle. When a gas discharge current flows to the plasma display panel in this state, the input impedance of the panel decreases, but the output impedance of the circuit remains high. Then, the panel voltage Vp abruptly decreases as shown by the dotted curve of FIG. 35(*a*), resulting in the effective decrease in applied voltage. This consequently decreases the intensity of the gas discharge to reduce a display luminance, and causes the wall charges to vanish, failing to continue the sustain discharge.

For reference purposes, FIG. 36 schematically shows how the rising edge of the panel voltage Vp changes depending upon the set value of the inductance L of the inductor 11. The curves C1, C2 and C3 of FIG. 36 show the waveforms of the panel voltage Vp when the inductance L is set to three values L1, L2 and L3, respectively, where L1<L2<L3. The curve C1 shows the waveform at the highest resonance frequency and, accordingly, exhibits the highest rate of rise at the rising edge (the lowest Q-value), but reaches the lowest level (first level) V1.

In contrast, when the inductance L is set to the value L3, the resonance frequency is the lowest and the Q-value is the highest. Then, the rate of rise at the rising edge of the panel voltage Vp is the lowest, and the panel voltage Vp changes slowly. The first level V1 at this time is the highest. Thus, as the inductance L is changed to a higher value such as during a transition from the curve C1 to the curve C3, the first level V1 on the increase approaches the firing voltage Vf and exceeds the firing voltage Vf in the course of time. A gas discharge is initiated before the panel voltage Vp reaches the pulse voltage Vcc which is the power supply voltage. In the case of the curve C3, in particular, if the panel voltage Vp is still rising slowly toward the first level V1 after an elapse of the gas discharge delay time to be described later since the point of time where Vp=Vf, a gas discharge is initiated before the panel voltage Vp reaches the first level V1, resulting in the change of the curve C3 as indicated by the broken curve of FIG. 35(*a*).

The firing voltage Vf is defined to mean a minimum voltage applied between the first and second (X, Y) electrodes when the gas discharge is actually initiated. The sum of the voltage developed by the wall charge and the firing voltage Vf corresponds to a gas discharge starting voltage in the discharge space 114 of FIG. 27. Strictly speaking, the gas discharge does not occur as soon as voltage is applied to the display panel but is initiated after some delay time. Therefore, the firing voltage Vf varies depending on the rate of change in panel voltage or the rising rate of the panel voltage.

Whether or not the discharge is initiated during the time illustrated in State (1) depends on the following two factors:

(i) The rate of voltage change at the rising edge or the rising rate in the resonant LC circuit (the rising rate if it is low is disadvantageous). (ii) The level reached by the voltage using the resonant LC circuit (that is, the first level V1 of FIG. 35(*a*); the first level if it is high is disadvantageous).

Which one of the two factors is a more significant problem depends on the relationship between the rising rate of the panel voltage Vp and the discharge delay time (typically about 100 to 500 ns).

Increasing the inductance L of the inductor 11 for the purpose of increasing the Q-value of the resonant LC circuit for high recovery efficiency causes a slow rise of the panel voltage Vp to reflect the problem of the factor (i), and also increases the first level V1 during the charging of the panel to reflect the problem of the factor (ii). In either case, the prevention of the adverse effects upon the gas discharge on the panel requires the reactive power recovery efficiency to be somewhat sacrificed.

In this manner, there exists a tradeoff between the enhancement of the power recovery efficiency by the increase in Q-value and the maintenance and improvement of the discharge characteristics in the panel.

To solve the tradeoff problem, technique disclosed in Japanese Patent Application Laid-Open No. P05-265397A (1993) (a third prior art) employs separate inductors provided respectively for the rising and falling edges of a pulse. In this technique, the inductors are interchanged for use at the rising and falling edges so that the pulse rises fast and falls slowly. This arrangement, however, requires the separate inductors for respective use at the rising edge and falling edge of the pulse to result in the increased number of parts and the increased complexity of the structure, creating another problem of high costs.

Additionally, this technique does not solve the problem of the factor (ii). If the rising rate is not sufficiently faster than the delay time of gas discharge initiation, the recovery efficiency is not increased above a certain level due to the limitation of the factor (ii).

The prior art plasma display devices constructed as above described have found difficulties in increasing the reactive power recovery efficiency to a certain level or higher without adverse effects upon the gas discharge in the plasma display panel.

SUMMARY OF THE INVENTION

A first aspect of the present invention is intended for a method of driving a plasma display panel having first and second electrodes at least one of which is covered with a dielectric, the plasma display panel repeatedly producing a gas discharge in response to a pulse voltage of alternately changed polarities applied between the first and second electrodes. According to the present invention, the method comprises the steps of: (a) charging a static capacitance element between the first and second electrodes through an inductor and storing energy in the inductor until the magnitude of current flowing through the inductor reaches a maximum value; (b) emitting the energy stored in the inductor toward the static capacitance element; and (c) charging the static capacitance element at a low impedance through a path which does not include the inductor in the course of the emission of the energy stored in the inductor toward the static capacitance element in addition to the emission, to supply a voltage corresponding to the pulse voltage to the static capacitance element, wherein the inductance value of the inductor is set so that a voltage-to-be-reached of the static capacitance element which is determined by a Q-value of a resonant LC circuit comprised of the inductor and the static capacitance element is higher than a gas discharge starting voltage and close to the pulse voltage if the static capacitance element is charged from the inductor but not through the path, and wherein the gas discharge starting voltage is a minimum voltage to be applied to the static capacitance element for production of the gas discharge.

Preferably, according to a second aspect of the present invention, in the method of the first aspect, switching from the step (b) to the step (c) is performed before the gas discharge is produced between the first and second electrodes.

Preferably, according to a third aspect of the present invention, in the method of the second aspect, the switching from the step (b) to the step (c) is performed before a potential difference between the first and second electrodes reaches the gas discharge starting voltage.

According to a fourth aspect of the present invention, a plasma display device comprises: a plasma display panel comprising first and second electrodes at least one of which is covered with a dielectric, the plasma display panel repeatedly producing a gas discharge in response to a pulse voltage applied between the first and second electrodes; and a drive circuit applying the pulse voltage between the first and second electrodes to drive the plasma display panel, the pulse voltage being of alternately changed polarities, the drive circuit comprising: (a) a power supply having the pulse voltage as a power supply voltage; (b) a switch element connected between at least the power supply and one electrode of the first and second electrodes; (c) an electric charge source; and (d) an inductor comprising a first end connected to the electric charge source, and a second end connected to the one electrode, the inductor and a static capacitance element between the first and second electrodes constituting a resonant LC circuit, wherein the inductor stores energy therein until the magnitude of current flowing through the inductor reaches a maximum value while charging the static capacitance element with electric charges supplied from the electric charge source, and subsequently emits the energy toward the static capacitance element, thereby charging the static capacitance element, wherein the switch element allows continuity between the power supply and the one electrode when a voltage applied to the static capacitance element reaches a second level, wherein relationships (the second level)<(a gas discharge starting voltage) and (the second level)<(a first level)<(the pulse voltage) hold, and wherein the first level is a voltage-to-be-reached of the static capacitance element which is determined by a Q-value of the resonant LC circuit if the switch element is non-conducting, and the gas discharge starting voltage is a minimum voltage to be applied to the static capacitance element for production of the gas discharge.

Preferably, according to a fifth aspect of the present invention, in the plasma display device of the fourth aspect, the electric charge source comprises: a capacitor charged with a voltage that is approximately one-half the pulse voltage.

Preferably, according to a sixth aspect of the present invention, in the plasma display device of the fourth aspect, the electric charge source comprises: a diode comprising an anode connected to the other electrode of the first and second electrodes, and a cathode connected to the inductor.

According to a seventh aspect of the present invention, a plasma display device comprises: an AC plasma display panel comprising first and second electrodes at least one of which is covered with a dielectric; a first pulse generating circuit applying a first sustain pulse to the first electrode; a second pulse generating circuit applying a second sustain pulse to the second electrode; and a control circuit controlling the first and second pulse generating circuits so that a first output time period of the first sustain pulse and a second output time period of the second sustain pulse partially overlap each other, wherein the first output time period is defined by the time when the first sustain pulse starts rising and the time when the first sustain pulse finishes falling, wherein the second output time period is defined by the time when the second sustain pulse starts rising and the time when the second sustain pulse finishes falling, and wherein one of the first and second pulse generating circuits which applies one of the first and second sustain pulses which rises earlier generates a pulse having a higher rate of voltage change at its rising edge and a higher rate of voltage change at its falling edge than does the other of the first and second pulse generating circuits.

Preferably, according to an eighth aspect of the present invention, in the plasma display device of the seventh aspect, each of the first and second pulse generating circuits comprises a power recovery portion comprising at least an inductor; and the inductor of the one of the first and second pulse generating circuits that generates the pulse having the higher rate of voltage change at its rising edge has a lower inductance value than does the inductor of the other of the first and second pulse generating circuits.

Preferably, according to a ninth aspect of the present invention, in the plasma display device of the seventh aspect, each of the first and second pulse generating circuits comprises a switch element for pulse generation; and the switch element of the one of the first and second pulse generating circuits that generates the pulse having the higher rate of voltage change at its rising edge has a higher switching rate and a higher on-resistance than does the switch element of the other of the first and second pulse generating circuits.

Preferably, according to a tenth aspect of the present invention, in the plasma display device of the ninth aspect, the switch element of the one of the first and second pulse generating circuits that generates the pulse having the higher rate of voltage change at its rising edge is a field effect transistor, and the switch element of the other of the first and second pulse generating circuits is a junction bulk transistor.

Preferably, according to an eleventh aspect of the present invention, in the plasma display device of the seventh aspect, the first pulse generating circuit comprises: a wall charge polarity adjusting pulse generating portion generating and outputting a pulse for inverting the polarity of a wall charge generated immediately after a gas discharge sustain operation is completed.

Preferably, according to a twelfth aspect of the present invention, in the plasma display device of the seventh aspect, the second pulse generating circuit comprises: a wall charge polarity adjusting pulse generating portion generating and outputting a pulse for inverting the polarity of a wall charge generated immediately after a gas discharge sustain operation is completed.

In accordance with the first aspect of the present invention, this method provides the highest possible reactive power recovery efficiency which exerts no adverse effects upon gas discharge characteristics of the plasma display.

In accordance with the second aspect of the present invention, the output impedance of the drive circuit may be decreased before the gas discharge is initiated. This reliably prevents the adverse effects upon the gas discharge characteristics of the plasma display.

Further, high reactive power recovery efficiency may be provided which exerts no adverse effects upon the gas discharge characteristics.

In accordance with the third aspect of the present invention, the output impedance of the drive circuit may be decreased before the gas discharge is initiated. This reliably prevents the adverse effects upon the gas discharge characteristics of the plasma display.

Further, high reactive power recovery efficiency may be provided which exerts no adverse effects upon the gas discharge characteristics.

In accordance with the fourth aspect of the present invention, the plasma display device provides the highest possible reactive power recovery efficiency which exerts no adverse effects upon the gas discharge characteristics of the plasma display.

In accordance with the seventh aspect of the present invention, the pulse to be applied to one of the electrodes produces a gas discharge at both the rising and falling edges whereas the pulse to be applied to the other electrode produces no gas discharge at both the rising and falling edges. Each of the pulse generating circuits can independently optimize the rising and falling rates of the pulse and the output impedance.

Additionally, in accordance with the seventh aspect of the present invention, the plasma display device may make faster only the rising edge of the pulse at the time of the initiation of the gas discharge, accomplishing high reactive power recovery efficiency without exerting the adverse effects upon the gas discharge characteristics of the plasma display.

In accordance with the eighth aspect of the present invention, the plasma display device may make faster only the rising edge of the pulse at the time of the initiation of the gas discharge, accomplishing high reactive power recovery efficiency without exerting the adverse effects upon the gas discharge characteristics of the plasma display.

The ninth aspect of the present invention allows the use of the switch element having a low on-resistance while maintaining the faster rising edge of the pulse at the time of the initiation of the gas discharge, to reduce power losses in the switch element without exerting the adverse effects upon the gas discharge characteristics of the plasma display, thereby achieving the reductions in power consumption, circuit element size, and costs.

The tenth aspect of the present invention allows the use of the switch element having a low on-resistance while maintaining the faster rising edge of the pulse at the time of the initiation of the gas discharge, to reduce power losses in the switch element without exerting the adverse effects upon the gas discharge characteristics of the plasma display, thereby achieving the reductions in power consumption, circuit element size, and costs.

It is therefore an object of the present invention to provide a plasma display device and a method of driving a plasma display panel which accomplish a high reactive power recovery efficiency at low costs without adverse effects upon gas discharge characteristics.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 10(*a*) through 10(*e*) are a timing chart showing the drive waveforms according to a fourth preferred embodiment of the present invention;

FIGS. 11(*a*) through 11(*e*) are a timing chart showing the drive waveforms according to a fifth preferred embodiment of the present invention;

FIGS. 12(*d*) through 12(*g*) are waveform charts showing the prior art process of charging;

FIGS. 17(*a*) through 17(*e*) are a timing chart of the switch control signals according to the sixth preferred embodiment;

FIGS. 18(*a*) through 18(*e*) are a timing chart of prior art switch control signals shown in FIG. 30;

FIGS. 20((*c*) shows a time axis;

FIGS. 29(*a*0) through 29(*f*0) illustrate the movement of wall charges in response to a priming pulse;

FIG. 30 is a circuit diagram of an X common driver of a conventional sustain pulse generating circuit;

FIGS. 31(*a*) and 31(*b*) illustrate the operation of the circuit of FIG. 30;

FIG. 35(*a*) illustrates chances in panel voltage in response to a discharge current;

FIG. 35(*b*) illustrates changes in discharge current; and

FIG. 36 shows the relationship between a Q-value of a resonant LC circuit and a voltage to be reached.

DESCRIPTION OF THE PREFERRED EMBODIMENTS

Preferred embodiments according to the present invention will now be described.

First Preferred Embodiment

Figure 1:
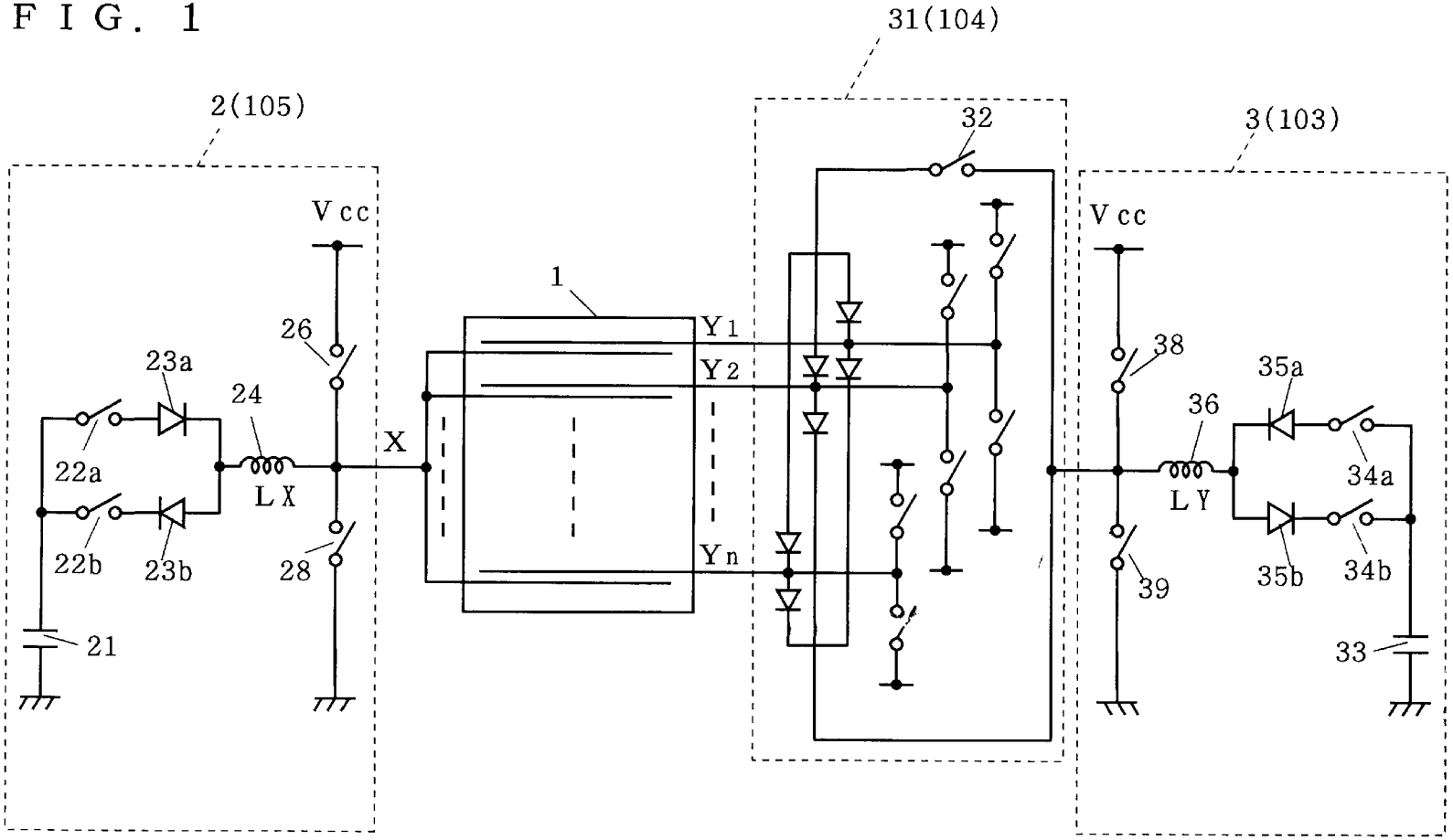
FIG. 1 is a circuit diagram of a sustain pulse generating circuit according to a first preferred embodiment of the present invention.
Figures 2A, 2B, 2C, 2D, 2E:
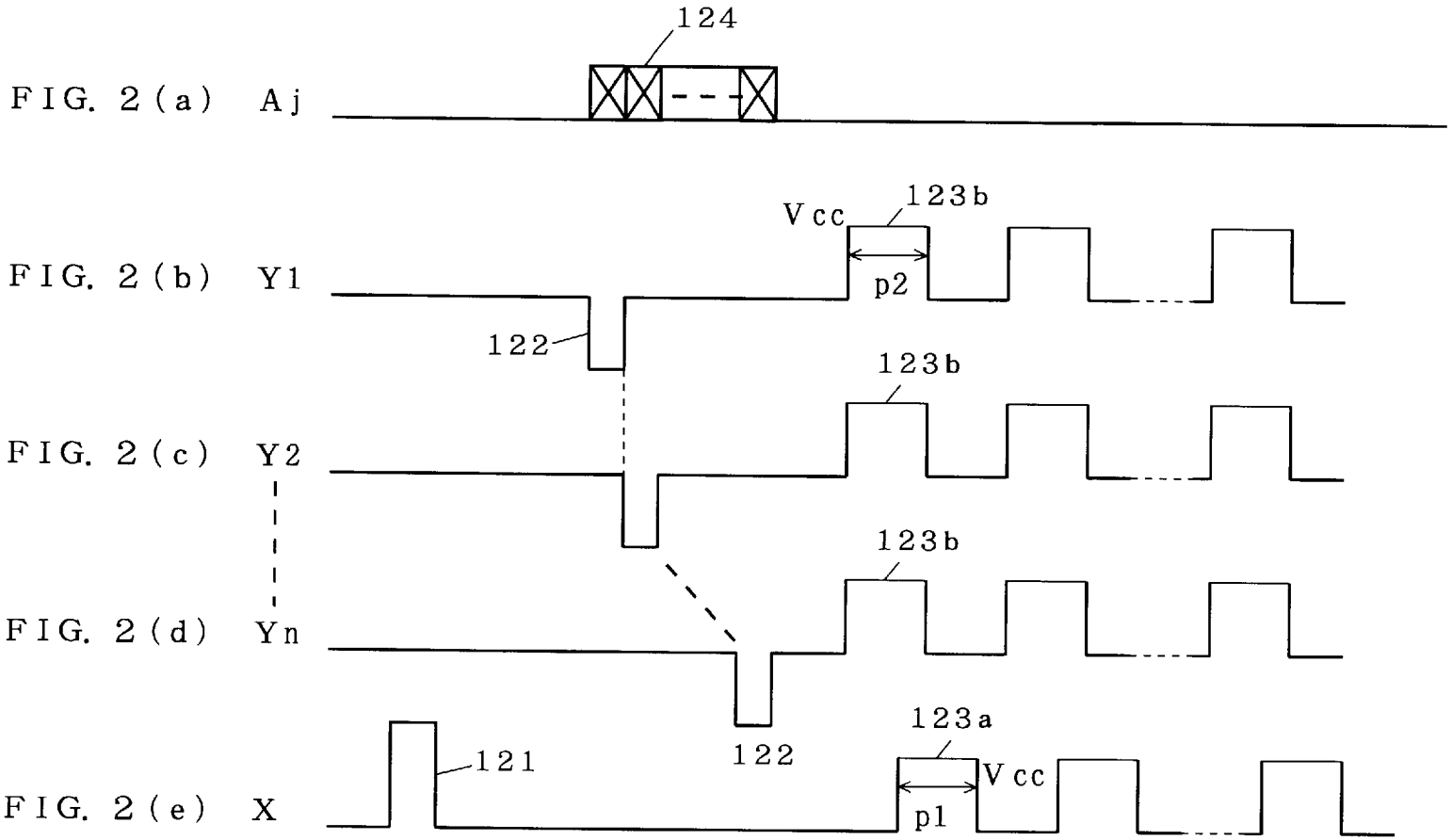
FIGS. 2(*a*) through 2(*e*) are a timing chart showing drive waveforms according to the first preferred embodiment of the present invention.
Figure 3:
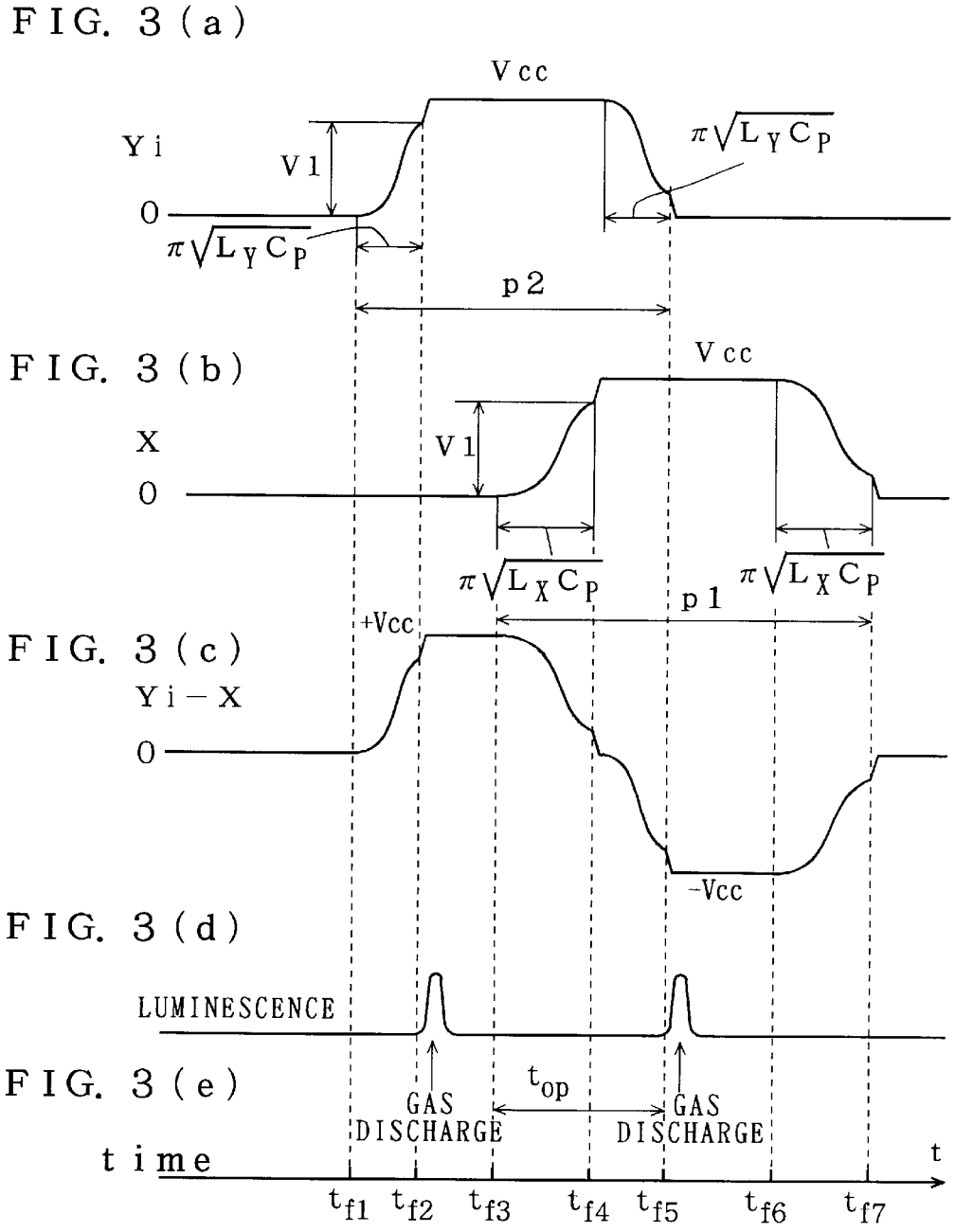
FIGS. 3(*a*) through 3(*e*) show sustain pulses on an enlarged scale.

FIG. 1 is a circuit diagram of a sustain pulse generating circuit according to a first preferred embodiment of the present invention. FIGS. 2(*a*) through 2(*e*) are waveform charts of drive waveforms of sustain pulses 123*a* and 123*b* generated by the sustain pulse generating circuit of FIG. 1 and an address pulse 124. FIGS. 3(*a*) through 3(*e*) show the sustain pulses 123*a* and 123*b* of FIGS. 21(*b*) through 2(*e*) and a pulse indicative of a potential difference therebetween on an enlarged scale.

Figure 4:
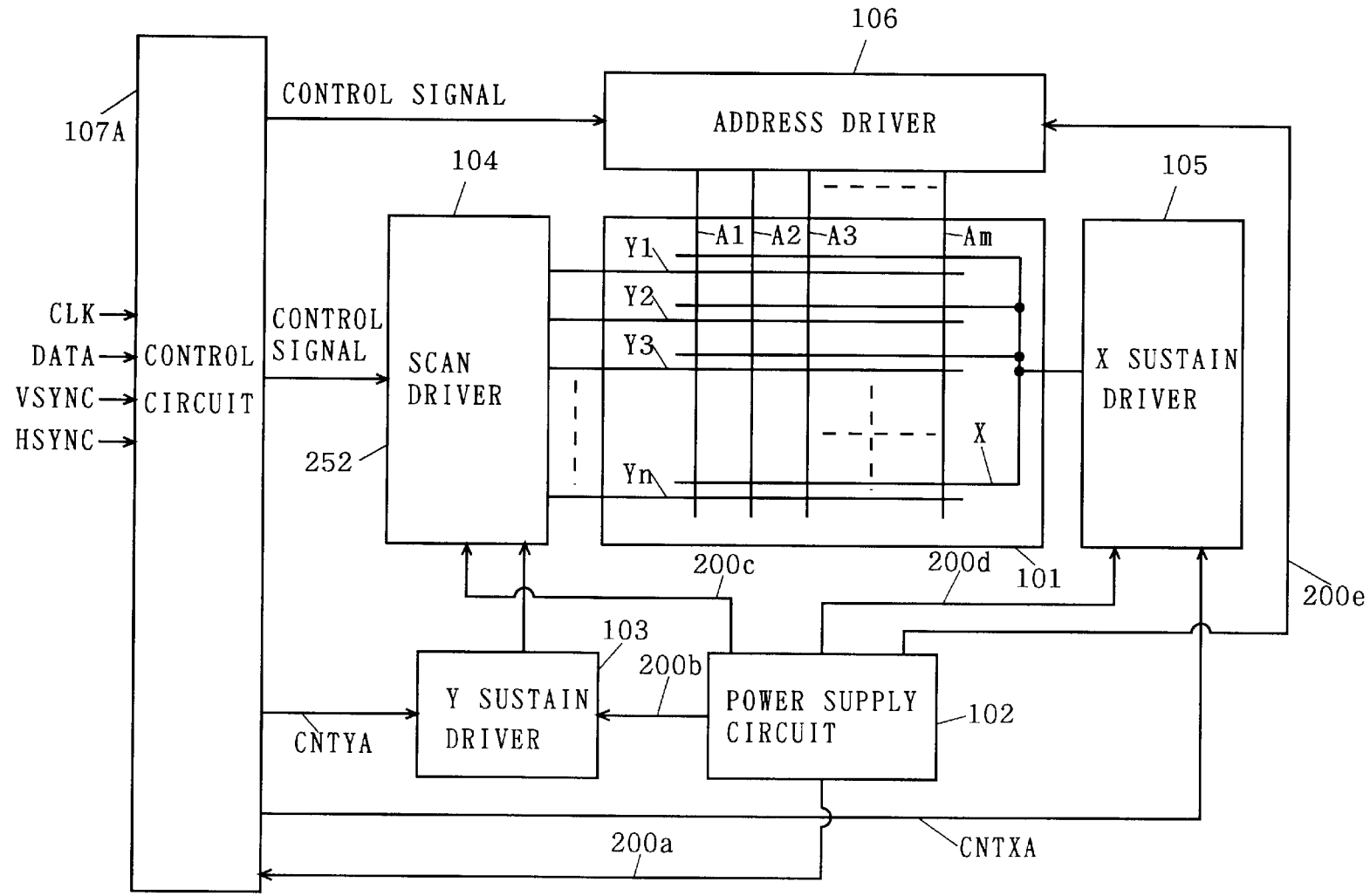
FIG. 4 is a block diagram showing the general construction of a plasma display device according to the first preferred embodiment.
Figure 27:
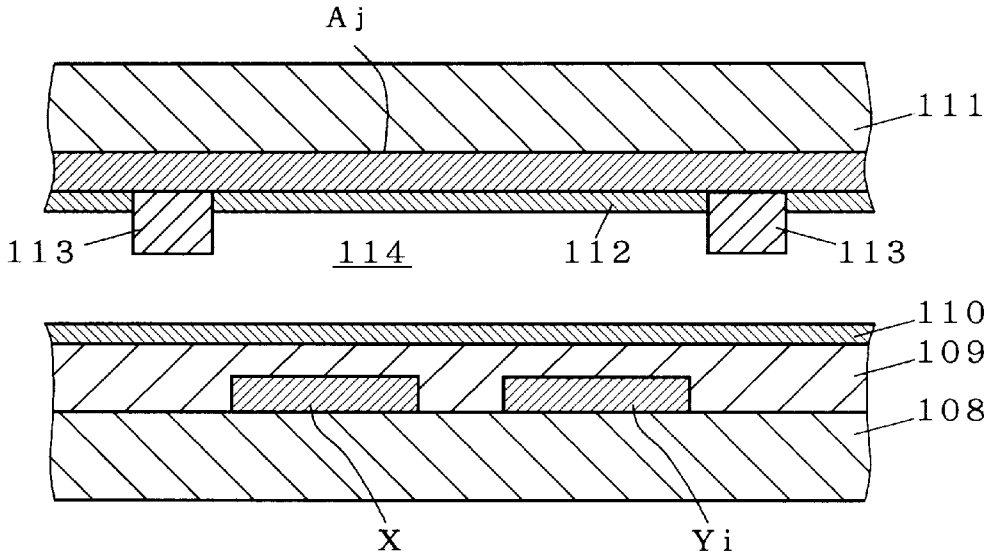
FIG. 27 is a sectional view of a cell of the plasma display panel.

The general construction of a plasma display device of the first preferred embodiment is shown in FIG. 4, and the structure of a plasma display panel according to the present invention is similar to that shown in FIG. 27.

Figure 26:
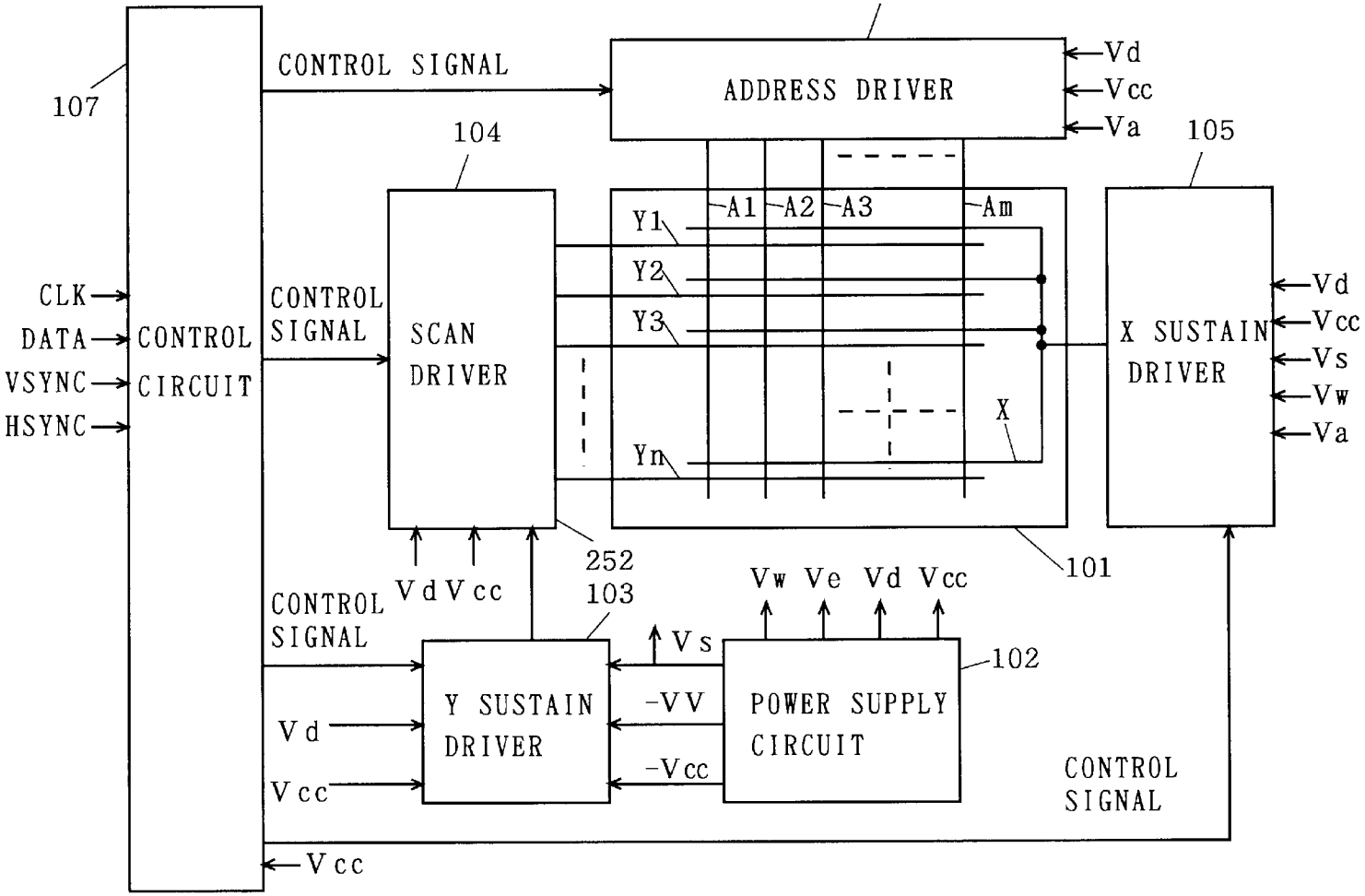
FIG. 26 (PRIOR ART)
FIG. 26 is a schematic diagram showing the construction of a plasma display.

A difference between the arrangements of FIGS. 4 and 26 exists in control circuits 107A and 107. In terms of the circuit arrangement, the control circuit 107A according to the present invention may be readily implemented by making a modification permitted in the form of general design items to the prior art circuit 107 However, the control circuit 107A significantly differs in function from the prior art circuit 107 as will be described later, and may be regarded in this sense as a novel circuit having a novel function.

The reference characters 200*a*, 200*b*, 200*c* and 200*d* in FIG. 4 designate signal lines for supplying a power supply voltage.

In FIG. 1, the reference numeral 1 designates a display panel which comprises a first glass substrate serving as a first substrate, sustain electrodes X as first electrodes and scan electrodes Y1 to Yn as second electrodes which are formed on the first glass substrate and arranged in parallel, a second glass substrate (not shown) opposed to the first glass substrate and serving as a second substrate, and address electrodes (not shown) as third electrodes which are formed on the second glass substrate and arranged in a direction perpendicular to the direction in which the sustain electrodes X and the scan electrodes Y1 to Yn are arranged.

The reference numeral 2 designates an X sustain driver serving as a first pulse generating circuit; and 3 designates a Y sustain driver serving as a second pulse generating circuit. The X sustain driver 2 comprises a power recovery capacitor 21, first and second switch elements 22*a* and 22*b*, diodes 23*a* and 23*b* connected to each other with opposite polarities and connected in series with the first and second switches 22*a* and 22*b* respectively, an inductor 24, a third switch element 26 for holding the sustain electrodes X at a power supply voltage Vcc which is a (sustain) pulse voltage, and a fourth switch element 28 for holding the sustain electrodes X at a ground level. The X sustain driver 2 is a portion included in a driver 105 shown in FIG. 4 and outputs the sustain pulse voltage Vcc serving as a first sustain pulse to the sustain electrodes X.

The Y sustain driver 3 comprises a power recovery capacitor 33, first and second switch elements 34*a* and 34*b*, diodes 35*a* and 35*b* connected to each other with opposite polarities and connected in series with the first and second switch elements 34*a* and 34*b* respectively, an inductor 36, a third switch element 38 for holding the scan electrodes Yi at the power supply voltage Vcc which is the (sustain) pulse voltage, and a fourth switch element 39 for holding the scan electrodes Yi at the ground level. The Y sustain driver 3 corresponds to a driver 103 shown in FIG. 4, and outputs the sustain pulse voltage Vcc serving as a second sustain pulse to the scan electrodes Yi of a panel 101. A scan driver 31 comprises a switch element 32.

The drivers 2 and 3 are similar in circuit interconnect arrangement to those of FIG. 30 but remarkably differ in function therefrom.

The control circuit 107A shown in FIG. 4 generates control signals to be applied to the switches 22*a*, 22*b*, 26, 28, 38, 39, 34*a*, 34*b* in the drivers 2 and 3 The control signals to be applied to the switches 22*a*, 22*b*, 26, 28 are generically referred to as a first control signal CNTXA shown in FIG. 4, and the control signals to be applied to the switches 38, 39, 34*a*, 34*b* are generically referred to as a second control signal CNTYA shown in FIG. 4.

Figures 5A, 5B, 5C, 5D, 5E, 5F, 5G:
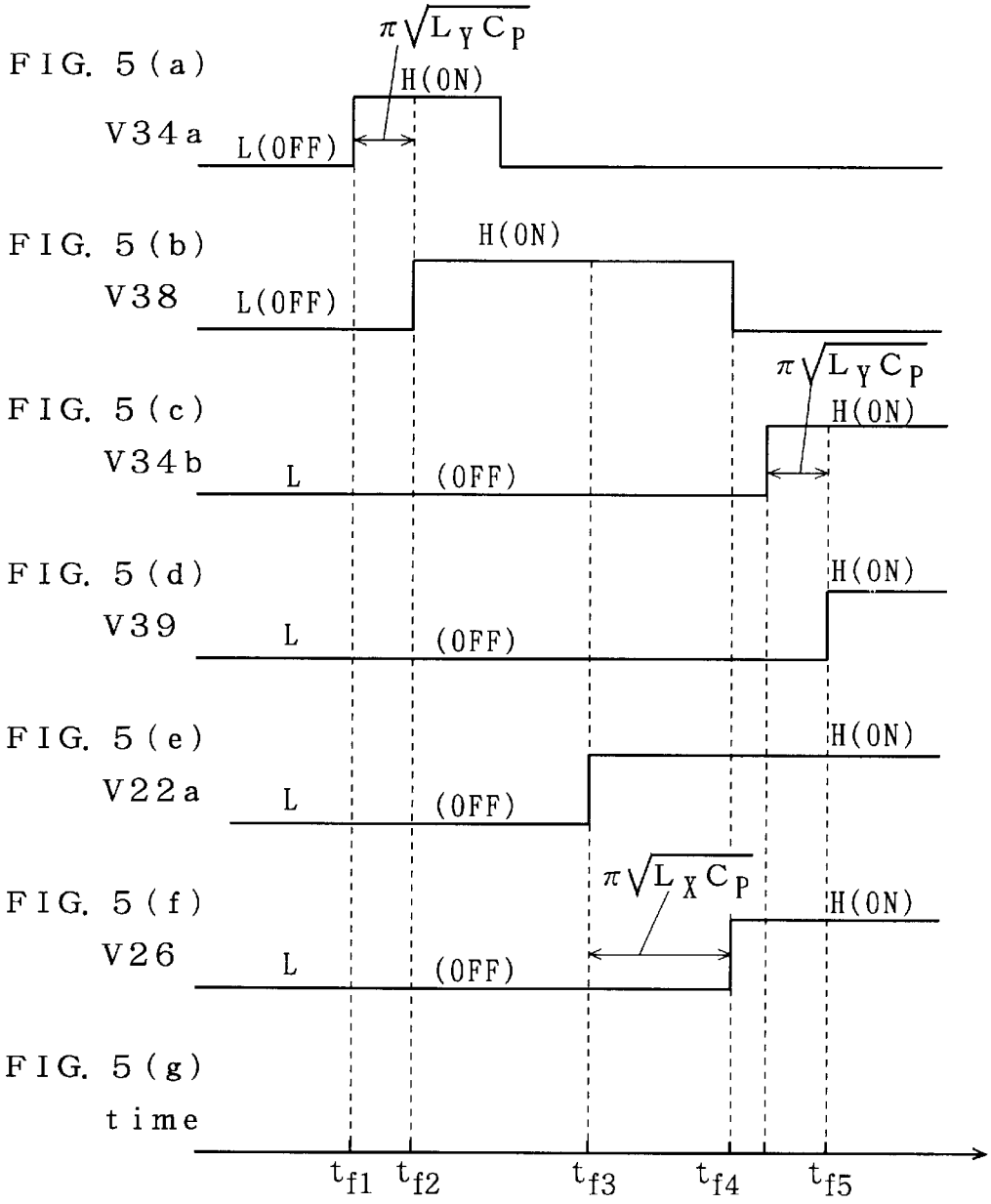
FIGS. 5(*a*) through 5(*g*) are a timing chart of switch control signals.

FIGS. 5(*a*) through 5(*g*) are a timing chart of the control signals to be applied to the respective switches. With reference to FIGS. 5(*a*) through 5(*f*), the reference characters V34*a*, V38, V341), V39, V22*a*, V26 designate signals for controlling the ON/OFF states of the switches 34*a*, 38, 34*b*, 39, 29*a*, 26 of FIG. 1, respectively. The symbol "H" denotes that the switches 34*a*, 38, 34*b*, 39, 22*a*, 26 are controlled to be in the ON state, and the symbol "L" denotes that the switches 34*a*, 38, 34*b*, 39, 22*a*, 26 are controlled to be in the OFF state.

In the first preferred embodiment, field effect transistors (FETs), for example, may be used as the switches 34*a*, 34*b*, 38, 39, 26, 28, 22*a*, 22*b*.

In the above described construction, the switch elements 26 and 38 correspond to the clamp switch S3 of FIG. 30, and the switch elements 28 and 39 correspond to the clamp switch S4.

In FIGS. 2(*a*) through 2(*e*), the reference numeral 121 designates a priming pulse; 122 designates a scan pulse; the reference characters 123*a* and 123*b* designate first and second sustain pulses (also referred to simply as sustain pulses hereinafter); and 124 designates an address pulse.

Operation will be described below.

Figures 28A, 28B, 28C, 28D, 28E, 28F:
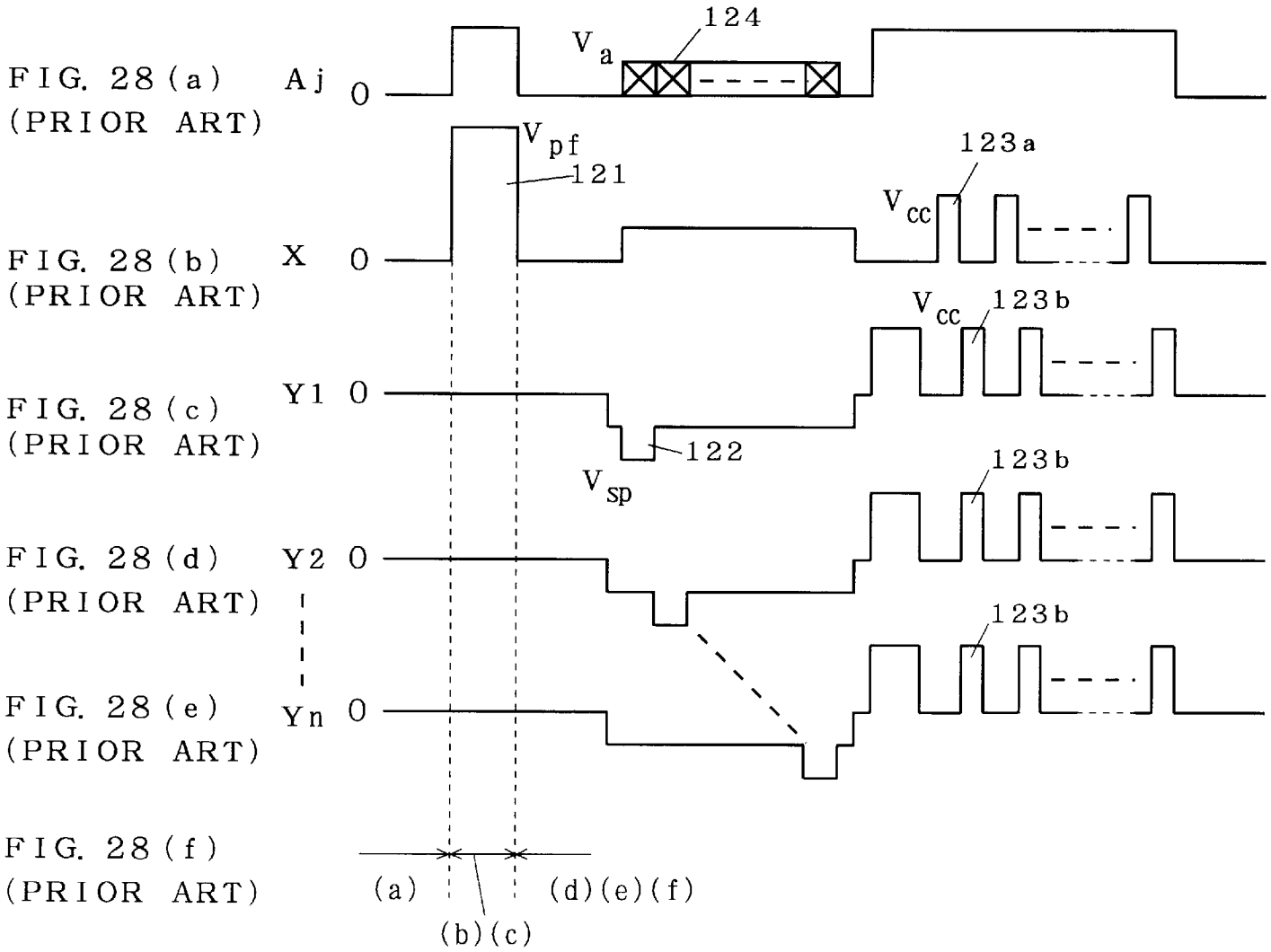
FIG. 28(a) (PRIOR ART)
FIG. 28(b) (PRIOR ART)
FIG. 28(c) (PRIOR ART)
FIG. 28(d) (PRIOR ART)
FIG. 28(e) (PRIOR ART)
FIG. 28(f) (PRIOR ART)
FIGS. 28(*a*) through 28(*f*) illustrate applied voltage waveforms for showing a method of driving the plasma display.
Figure 32:
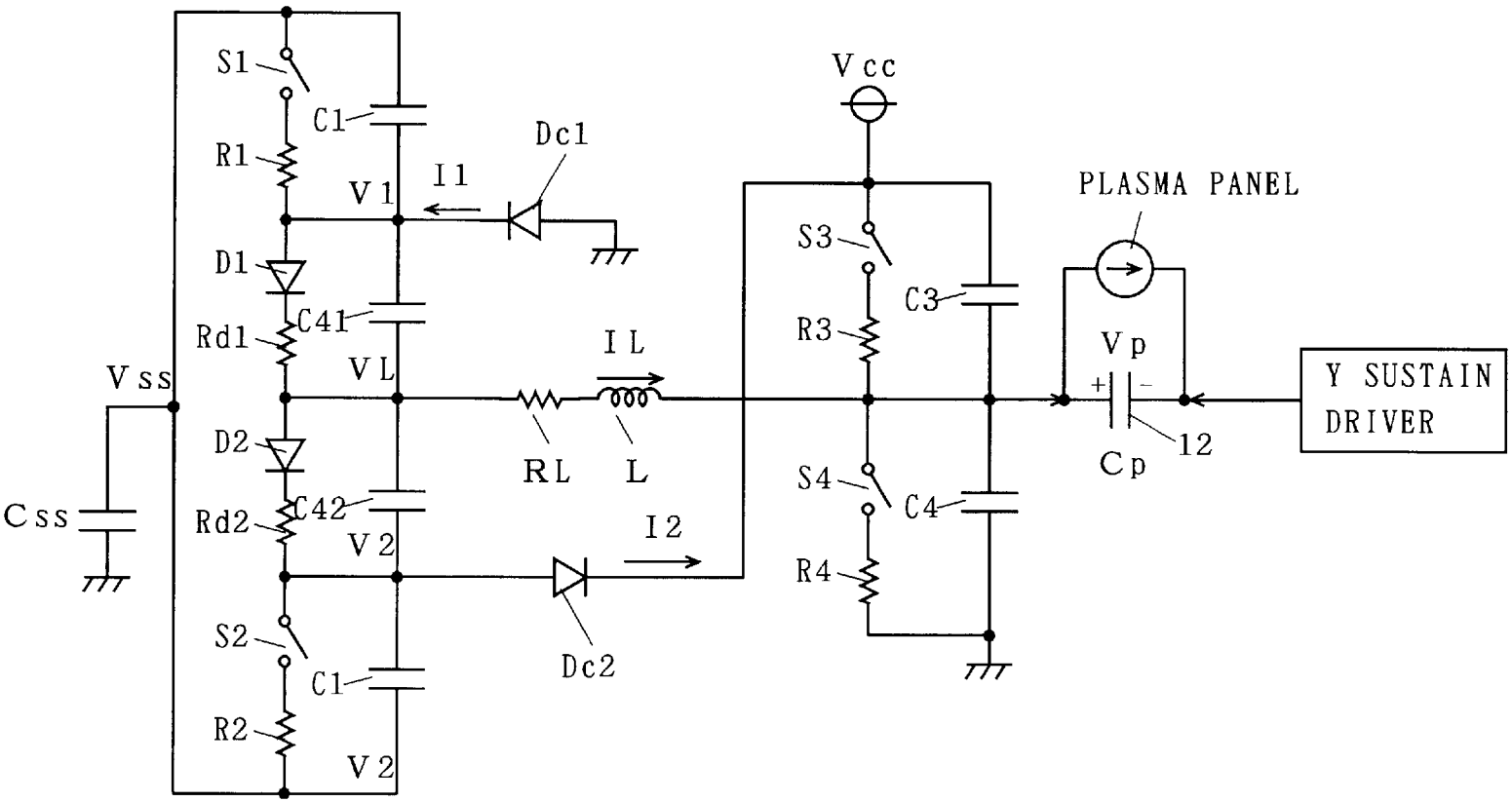
FIG. 32 (PRIOR ART)
FIG. 32 is an equivalent circuit diagram of the plasma display panel and a drive circuit.

With reference to FIGS. 2(*a*) through 2(*e*), the priming pulse 121 is initially applied to the sustain electrodes X to discharge all discharge cells once and to erase wall charges. Then, the scan pulses 122 are applied to the scan electrodes Yi (i=1 to n) in sequential order, and the address pulses 124 are applied to the address electrodes Aj in accordance with image data to cause a write discharge, thereby accumulating wall charges at cells to be illuminated for display. The operation discussed hereinabove is similar to the operation illustrated with reference to FIGS. 28(*a*) through 28(*f*).

Subsequently, the sustain pulses 123*a* and 123*b* at the voltage Vcc are alternately applied to the scan electrodes Yi and the sustain electrodes X to cause a display discharge. The waveforms of the sustain pulses 123*a* and 123*b* at this time are shown on an enlarged scale in FIGS. 3(*a*) through 3(*c*).

The sustain pulses 123*a* and 123*b* are outputted in a manner different from those of the prior art. Specifically, the second sustain pulse 123*h* to be applied to the scan electrodes Yi and the first sustain pulse 123*a* to be applied to the sustain electrodes X are generated so as to partially overlap on the time axis (the timing of X and Yi of FIGS. 3(*a*) through 3(*e*)).

In other words, the (second) output time period p2 of the second sustain pulse 123*b* and the (first) output time period p1 of the first sustain pulse 123*a* are in partially overlapping relation. During a time period $t_{op}$ shown in FIG. 3(*d*). both of the sustain pulses 123*a* and 123*b* are applied to the electrodes X and Yi, respectively. The term "output time period" used herein means a time period defined by the time when a pulse starts rising and the time when the pulse finishes falling.

Figure 33:
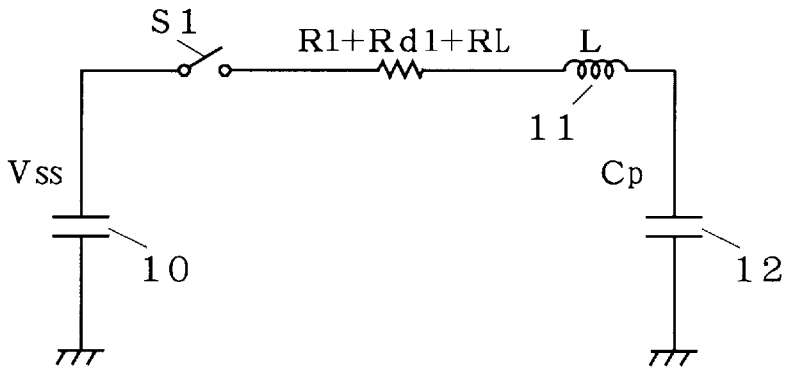
FIG. 33 (BACKGROUND ART)
FIG. 33 is a simplified equivalent circuit diagram of FIG. 32.
Figure 34A:
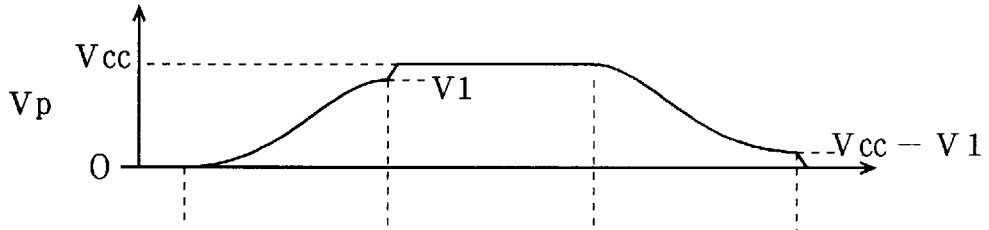
FIG. 34(a) (PRIOR ART)
FIGS. 34(*a*) and 34(*b*) illustrate the operation of the circuit of FIG. 32.
Figure 34B:
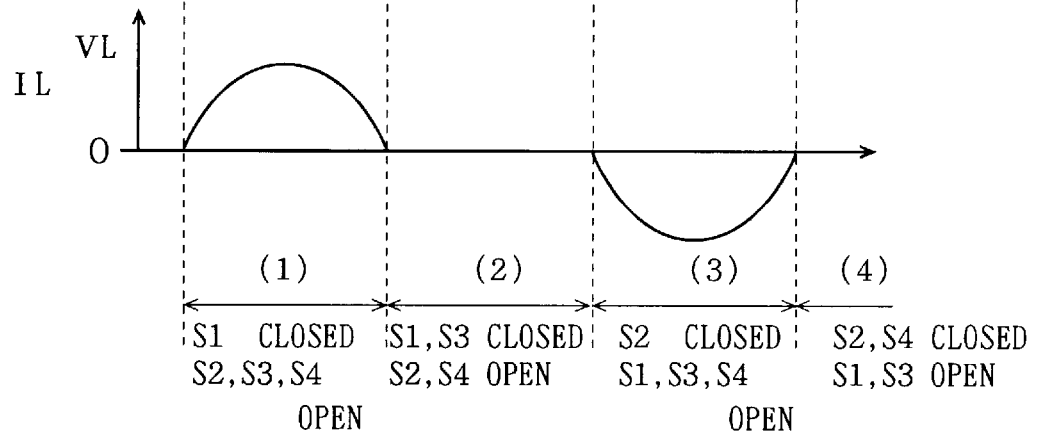
FIG. 34(b) (PRIOR ART)

At the rising and falling edges of the sustain pulses, the reactive power is recovered using the LC series resonance in a manner similar to the prior art (described with reference to FIGS. 30, 31(*a*) and 31(*b*)). Thus, the equivalent circuit of FIG. 33 is formed, and the waveforms of FIGS. 34(*a*) and 34(*b*) are generated. In this case, an inductance $L_y$ constituting one of the reactive power recovery circuits which outputs the sustain pulse that rises earlier (the reactive power recovery circuit for the scan electrodes Yi in the case of FIG. 3(*a*)) is set to a relatively low level to increase the rate of voltage change at the rising and falling edges of the second sustain pulse 123*b*, whereas an inductance $L_y$ constituting the other reactive power recovery circuit which outputs the sustain pulse that rises later (the reactive power recovery circuit for the sustain electrodes X in the case of FIG. 3(*b*)) is set to a relatively high level to decrease the rate of voltage change at the rising and falling edges of the first sustain pulse 123*a* ($L_Y<L_X$).

A potential difference between the scan electrodes Yi and the sustain electrodes X is contemplated, with the sustain pulses 123*a* and 123*b* applied in this fashion. During the time between $t_{f3}$ and $t_{f4}$, the voltage of the sustain electrodes X rises from 0V up to the sustain pulse voltage Vcc, but the potential difference (Yi−X) returns from the voltage Vcc to 0V in a reverse manner as indicated by the symbol Yi−X of FIG. 3(*c*). This causes no gas discharge. On the other hand, during the time between $t_{f4}$ and $t_{f5}$, the voltage of the scan electrodes Yi returns from the voltage Vcc to 0V, but the potential difference (Yi−X) falls from 0V to a negative-polarity sustain pulse voltage −Vcc. This causes a gas discharge. In this manner, the potential difference (Yi−X) has a waveform such that it changes rapidly at the edge (during the time between $t_{f1}$ and $t_{f2}$) at which it rises from 0V and a gas discharge occurs and at the edge (during the time between $t_{f4}$ and $t_{f5}$) at which it falls from 0V and a gas discharge occurs and such that it changes slowly at the edges (during the time between $t_{f3}$, and $t_{f4}$ and the time between $t_{f6}$ and $t_{f7}$) at which it returns to 0V (no gas discharge occurs).

In accordance with the first preferred embodiment, as above described, the waveform of the potential difference (Yi−X) between the scan electrodes and the sustain electrodes is adapted such that the potential difference changes rapidly at the edges where the gas discharge occurs and changes slowly at the edges where no gas discharge occurs. This allows the inductance for the sustain electrodes X to be set to a relatively high level without the adverse effects upon the gas discharge on the plasma display panel to increase the reactive power recovery efficiency for the sustain electrodes X, reducing power consumption.

The X sustain driver 2 and the Y sustain driver 3 require the single inductors 24 and 36, respectively. Therefore, the circuitry is prevented from complexity and implemented at relatively low costs.

Second Preferred Embodiment

Figure 6:
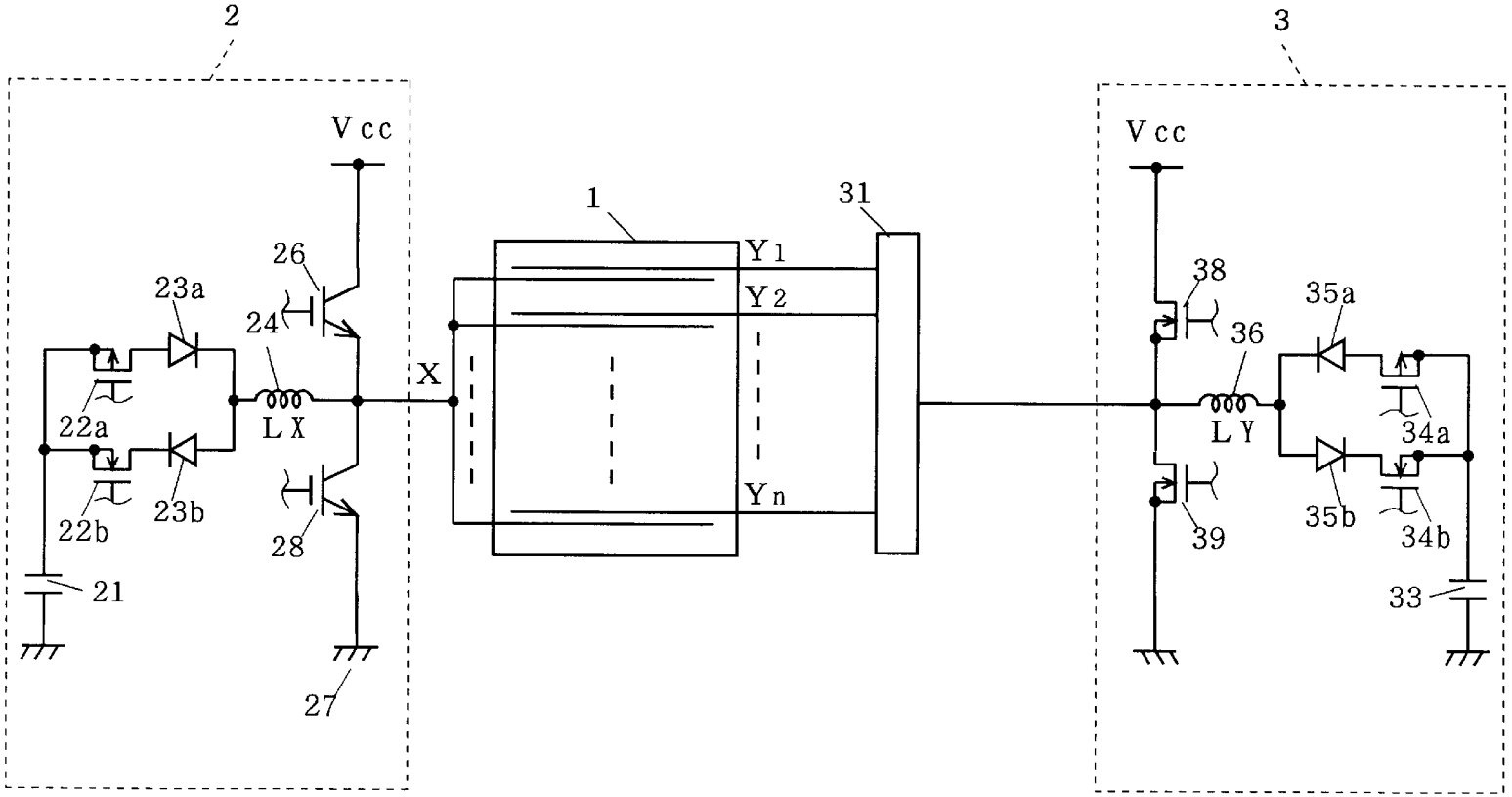
FIG. 6 is a circuit diagram of the sustain pulse generating circuit using practical devices according to a second preferred embodiment of the present invention.

FIG. 6 is a circuit diagram of the sustain pulse generating circuit using practical devices as the switch elements shown in FIG. 1 according to a second preferred embodiment of the present invention. Like reference numerals and characters are used to designate elements identical with those of FIG. 1, and the description thereof is dispensed with. In the second preferred embodiment, the Y sustain driver 3 for generating the sustain pulse having a high rate of voltage change at the rising and falling edges employs field effect transistors (FETs) as the switch elements thereof. The X sustain driver 2 for generating the sustain pulse having a low rate of voltage change at the rising and falling edges employs IGBTs or bipolar transistors as the switch elements such as the switch elements 26 and 28 although the FETs as in the first preferred embodiment may be also used. The IGBTs and bipolar transistors are generically referred to as "junction bulk transistors."

In the second preferred embodiment, the switch elements having a low switching rate may be used in the driver wherein a pulse is permitted to rise and fall slowly (for example, the driver for the sustain electrodes X). Thus, the switch elements having a low switching rate yet a low on-resistance are used. This reduces power losses in the switch elements to achieve the reductions in power, circuit element size, and costs.

Third Preferred Embodiment

Figure 7:
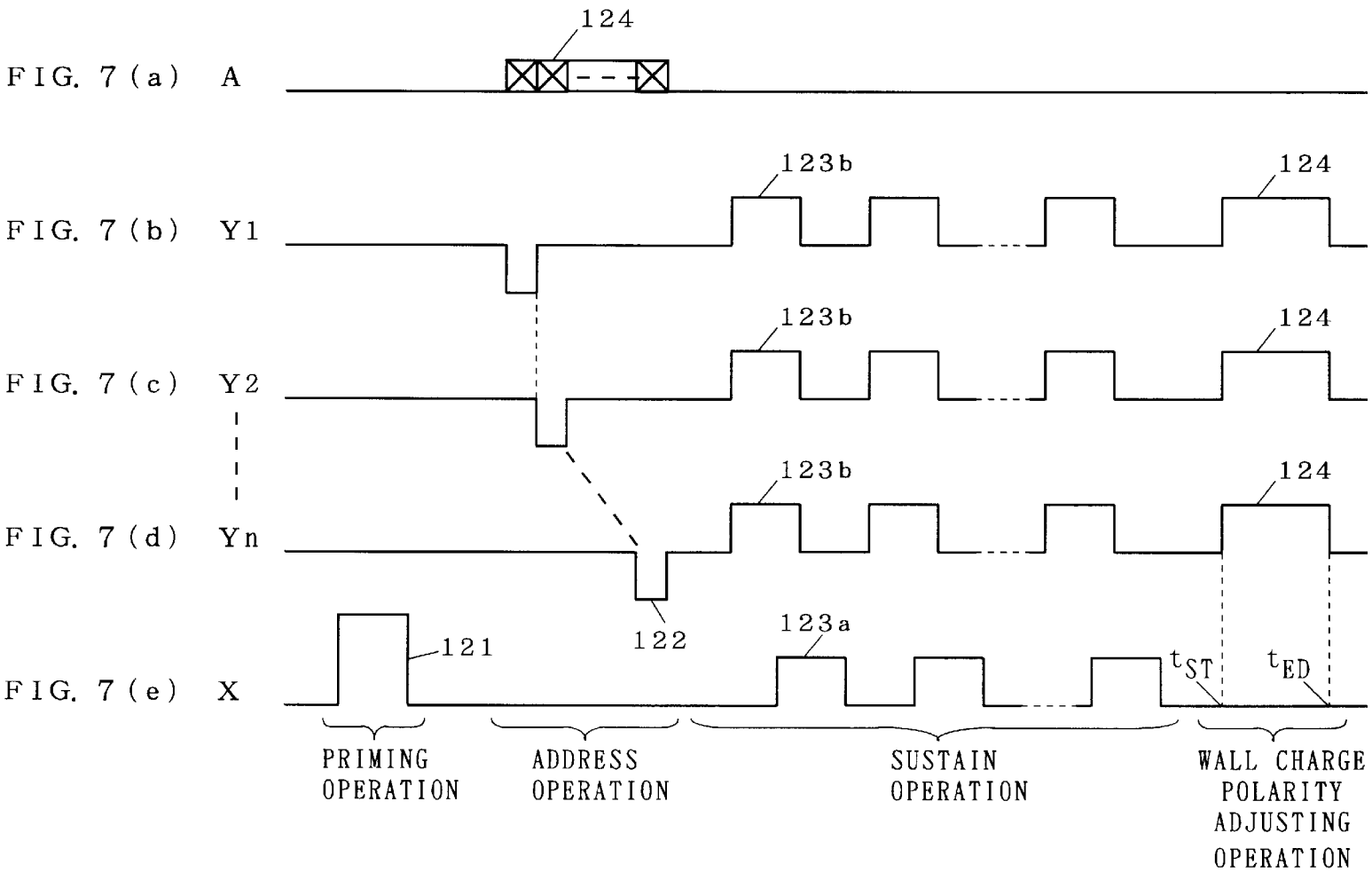
FIGS. 7(*a*) through 7(*e*) are a timing chart showing the drive waveforms according to a third preferred embodiment of the present invention.

FIGS. 7(*a*) through 7(*e*) are a timing chart showing the relationship between the priming pulse, the sustain pulses 123*a* and 123*b*, and the address pulse in the form of drive waveforms according to a third preferred embodiment of the present invention. A wall charge polarity adjusting pulse 124 which is independent of the second sustain pulse 123*b* is applied to the scan electrodes Yi immediately after the second sustain pulse 123*b* and the first sustain pulse 123*a* are all outputted. The third preferred embodiment adopts the basic construction of the first and second preferred embodiments and accordingly offers the advantages provided in the first and second preferred embodiments.

Figure 8:
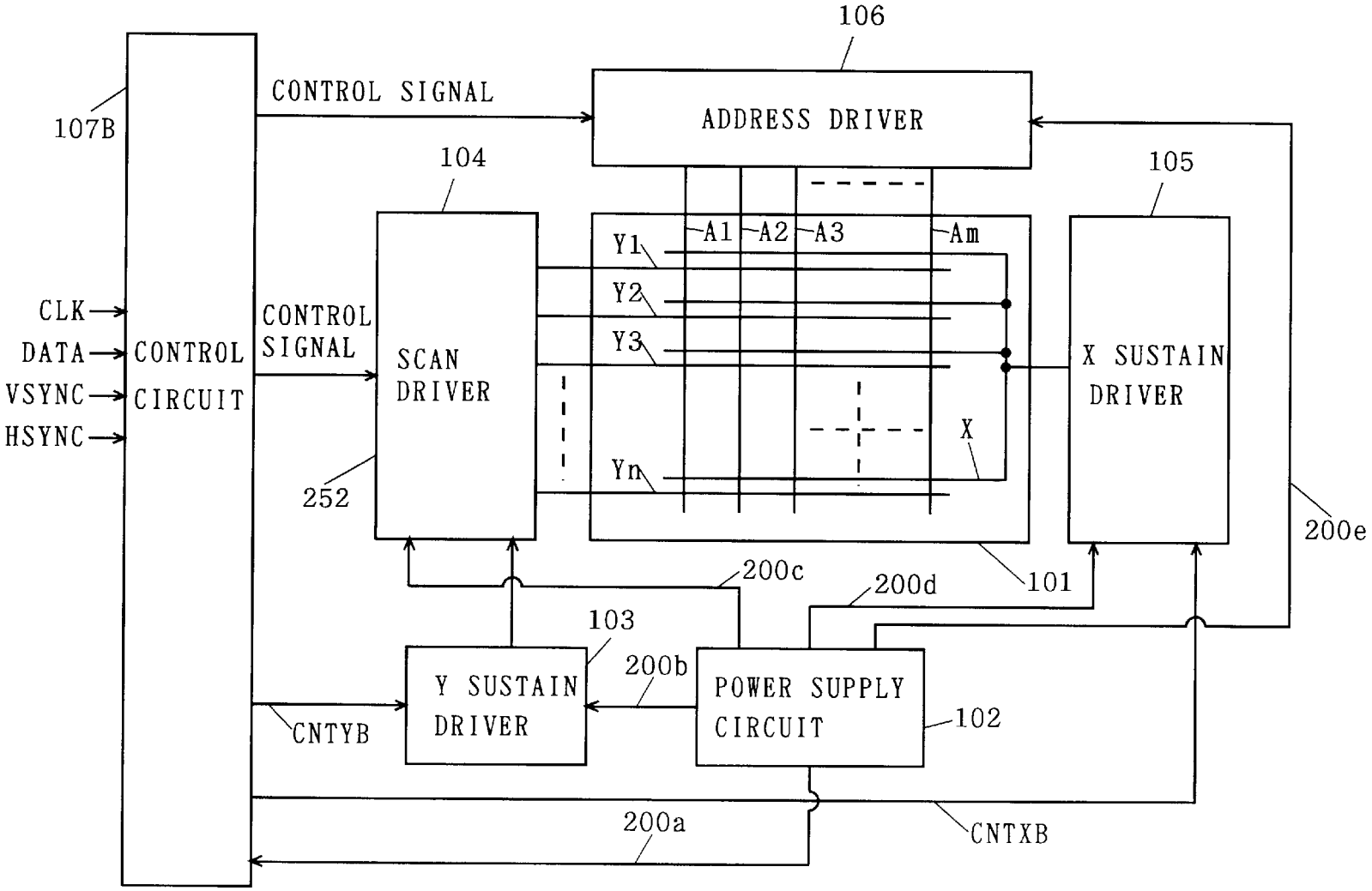
FIG. 8 is a block diagram showing the general construction of the plasma display device according to the second preferred embodiment.

FIG. 8 shows the general construction of the plasma display device according to the third preferred embodiment.

A difference between the arrangements of FIGS. 8 and 4 exists in control circuits 107B and 107A. Other elements of the third preferred embodiment are similar to those of the first and second preferred embodiments. The X and Y drivers 105 and 103 correspond to the drivers 2 and 3 of FIG. 1, respectively. A scan driver 104 correspond to the driver 31 of FIG. 1. The control circuit 107B differs from the control circuit 107A in that a second control signal CNTYB is outputted to the Y sustain driver 103. In the circuit arrangement, there is no difference between the circuits 107B and 107A except in function. The circuit 107B may be constructed only by modifying the circuit 107A within the range of known design items.

Figures 9A, 9B, 9C, 9D, 9E, 9F, 9G:
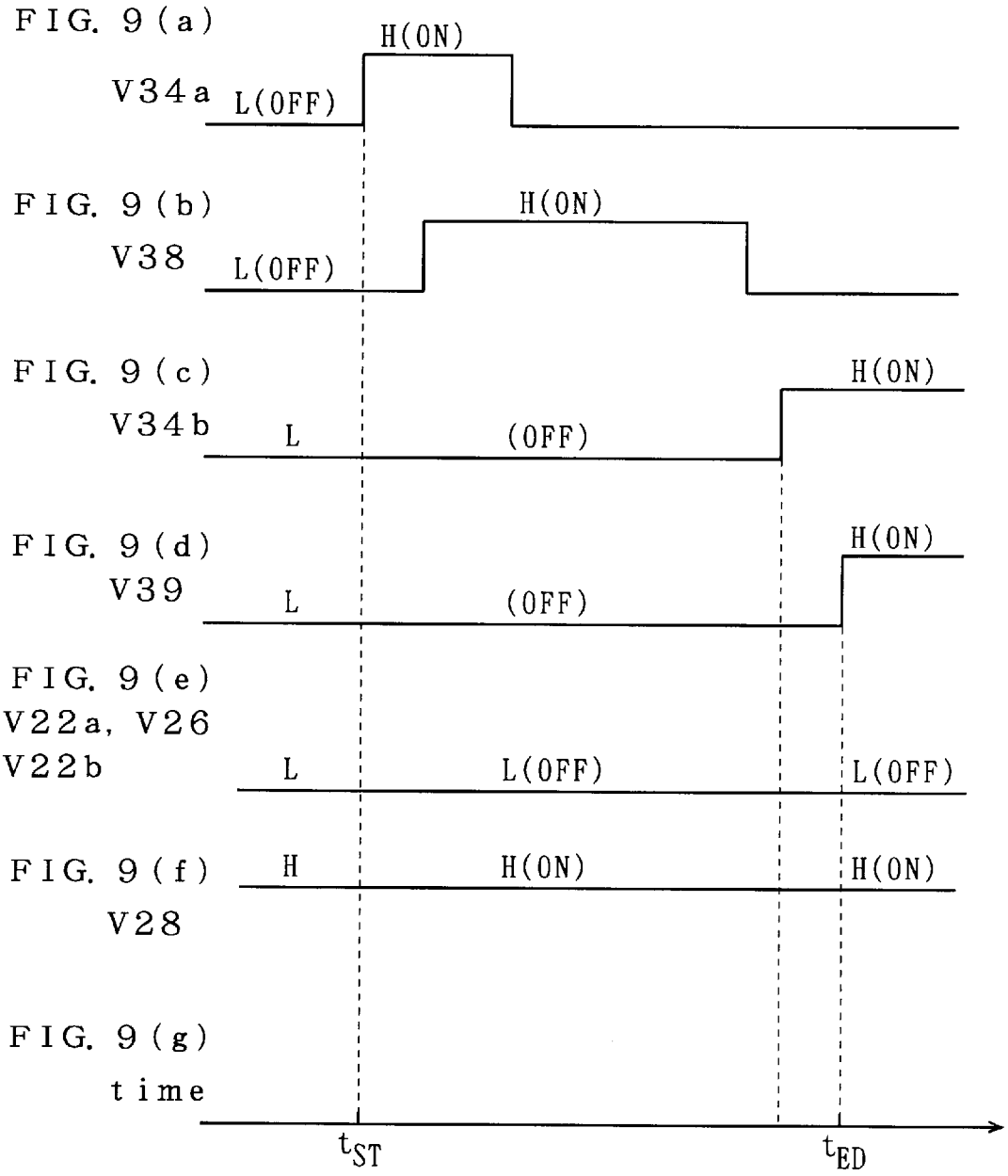
FIGS. 9(*a*) through 9(*g*) are a timing chart of the switch control signals.

The pulse 124 shown in FIGS. 7(*b*) through 7(*d*) is generated in separate relation to the second sustain pulse 123*b* in a manner to be described below. The control circuit 107B of FIG. 8 outputs the second control signal CN7TYB of FIG. X which is the generic representation of the first to fourth switch control signals of the switch elements of FIG. 1 to the Y driver 103 (Y driver 3 of FIG. 1) at time $t_{ST}$ shown in FIG. 7(*e*) when the first and second sustain pulses 123*a* and 123*b* are all outputted and the discharge sustain step is completed. At this time, the level of a first control signal CNTXB is unchanged. Thus, the first to fourth switches 34*a*, 34*b*, 38, 39 are controlled in accordance with the procedure shown in FIG. 31(*b*) to generate the pulse 124 having the same waveforms as those shown in FIGS. 34(*a*) and 34(*b*). FIGS. 9(*a*) through 9(*d*) are a timing chart of the first to fourth switch control signals V34*a*, V34*b*, V38, V39 to be applied at this time to the first to fourth switches 34*a*, 34*b*, 38, 39. FIGS. 9(*e*) and 9(*f*) are a timing chart of the control signals V22*a*, V22*b*, V26, V28 to be applied to the switches 22*a*, 22*b*, 26, 28.

If the first and second sustain pulses 123*a* and 123*b* are applied respectively to the electrodes X and Yi so that the output time period of the second sustain pulse 123*b* to be applied to the scan electrodes Yi and the output time period of the first sustain pulse 123*a* to be applied to the sustain electrodes X partially overlap each other, the sustain operation is terminated with the wall charges of the same polarity as the wall charges which have been accumulated prior to the sustain operation being left accumulated. Unfortunately, (1) the polarity of the wall charges which have been accumulated prior to the sustain operation and (2) the polarity of the wall charges required to satisfactorily perform the operation following the sustain operation are not necessarily the same.

For example, when the pulses having the drive waveforms shown in FIGS. 7(*a*) through 7(*e*) are applied, positive wall charges are accumulated on the scan electrodes Yi and negative wall charges are accumulated on the sustain electrodes X after the address operation (prior to the start of the sustain operation). For initiation of the sustain operation in this state, the pulse to be applied to the scan electrodes Yi should be raised first (so that the wall voltage due to the wall charges and the voltage applied from the exterior are added together).

In this case, if the sustain pulses to be applied to the scan electrodes Yi and the sustain electrodes X are made to overlap (that is, the trailing edge of the sustain pulse to be applied to the scan electrodes Yi and the leading edge of the sustain pulse to be applied to the sustain electrodes X overlap on the time axis), the last pulse in the sustain operation is the sustain pulse to be applied to the sustain electrodes X. As a result, the positive wall charges are accumulated on the scan electrodes Yi and the negative wall charges are accumulated on the sustain electrodes X after the end of the sustain time period. That is, the wall charges are of the same polarities as those present prior to the start of the sustain operation. However, prior to the application of the priming pulse to the sustain electrodes X in the subsequent drive period, it is necessary that negative wall charges are accumulated on the scan electrodes Yi and positive wall charges are accumulated on the sustain electrodes X so as not to prevent the priming discharge.

To this end, in the third preferred embodiment, the wall charge polarity adjusting pulse for inverting the polarities of the respective wall charges on the scan electrodes Yi and sustain electrodes X is applied after the sustain operation to invert the polarities of the wall charges, thereby insuring the priming, discharge in the next drive period.

Fourth Preferred Embodiment

FIGS. 10(*a*) through 10(*e*) are a timing chart showing the relationship between the priming pulse, the sustain pulses, and the address pulse in the form of drive waveforms according to a fourth preferred embodiment of the present invention. In the fourth preferred embodiment, unlike the third preferred embodiment, a wall charge polarity adjusting pulse 125 independent of the sustain pulses is generated in the Y driver 3 of FIG. 1 and applied to the scan electrodes Yi after the address operation and immediately before the initiation of the sustain operation. In this case, the inductance $L_x$ of FIG. 1 is set so as to increase the rate of voltage change both at the rising and falling edges of the first sustain pulse 123*a* to be applied to the sustain electrodes X whereas the inductance $L_Y$ of FIG. 1 is set so as to decrease the rate of voltage change at the rising and falling edges of the second sustain pulse 123*b* to be applied to the scan electrodes Yi ($L_X<L_Y$). This allows the enhancement of the reactive power recovery efficiency for the scan electrodes Yi in contrast to the first and second preferred embodiments. Therefore, the fourth preferred embodiment produces effects similar to those of the third preferred embodiment while maintaining the advantages of the first and second preferred embodiments.

In the fourth preferred embodiment, since the wall charge polarity adjusting pulse 125 is generated independently of the sustain pulses 123*a* and 123*b* whose output time periods partially overlap each other, the pulse width of the pulse 125 may be freely controlled. In particular, if the pulse width of the pulse 125 is set greater than the pulse widths of the pulses (sustain pulses 123*a* and 123*b*) applied during the sustain operation, the polarities of the wall charges prior to the initiation of the sustain operation may be adjusted, and the wall charges being accumulated may be stabilized.

A method of generating the pulse 125 and a structure therefor are basically similar to the method of generating the pulse 124 and the structure therefor which are described in the third preferred embodiment.

Fifth Preferred Embodiment

Although the sustain pulses which are positive in polarity have been described in the first to fourth preferred embodiments, negative pulses whose output time periods partially overlap each other may be used as the sustain pulses 123*a* and 123*b* as shown in FIGS. 11(*a*) through 11(*e*), providing similar functions and effects.

Sixth Preferred Embodiment

The first to fifth preferred embodiments have described the technique of increasing the substantial rate of voltage change at the rising edge of the sustain pulses, that is, the rising rate at the edge where the gas discharge is produced to increase the reactive power recovery efficiency at low costs of the drive circuit while exerting less influence upon the gas discharge.

As stated in the description of the background art, whether or not a gas discharge is initiated on the panel while current is being supplied from the inductor in the series resonant LC circuit depends also on the level to be reached bad a panel voltage Vp by using the series resonant LC circuit, which rather frequently becomes a problem. In consideration for this problem, a sixth preferred embodiment makes improvements for maximizing the reactive power recovered efficiency while setting as high as possible a first level V1 (See FIG. 34(*a*)) to be reached by the panel voltage Vp determined by the setting of the Q-value of the resonant LC circuit; in practice, by controlling or clamping the level to be reached by the panel voltage Vp so as to be lower than the first level V1 and at a level (second level V2 to be described later) lower than the firing voltage Vf.

Figure 13:
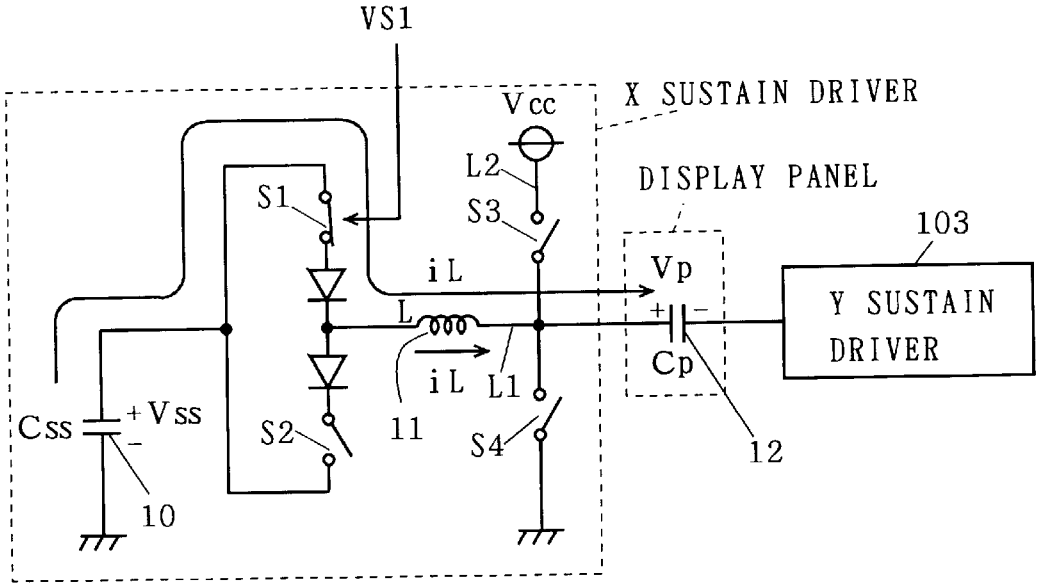
FIGS. 13, 14 and 15 illustrate current paths in the operation according to the sixth preferred embodiment of the present invention.
Figure 14:
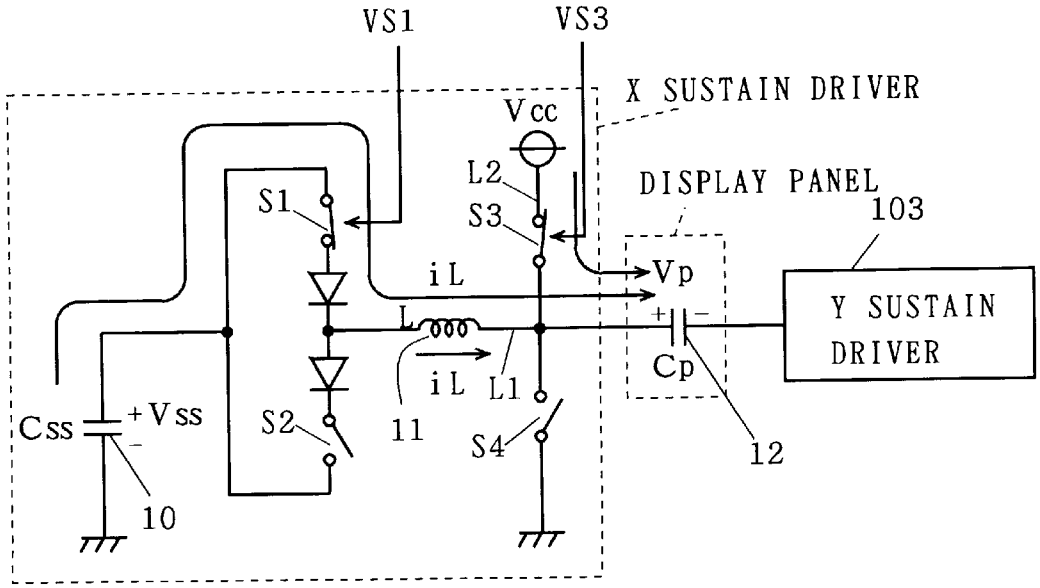
Figure 15:
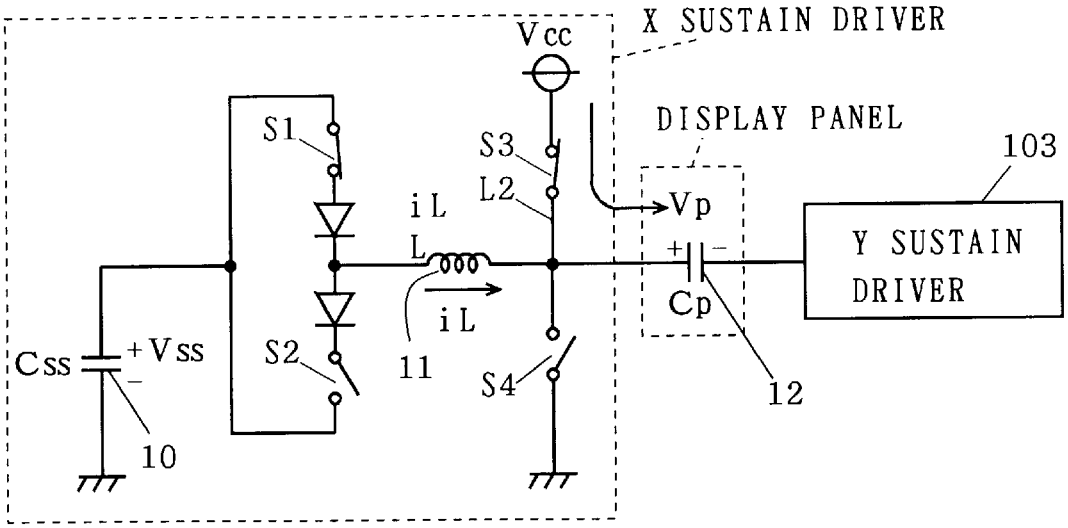

FIGS. 12(*a*) through 12(*c*) show voltage and current waveforms in the process of charging the plasma display panel using the LC resonance for illustration of the operation of the sixth preferred embodiment of the present invention. FIGS. 13, 14 and 15 are circuit diagrams for illustrating current paths in the operation. For purposes of distinction from the prior art, FIGS. 12(*d*) and 12(*e*) and FIGS. 12(*f*) and 12(*g*) show voltage and current waveforms in the prior art operation.

Figure 16:
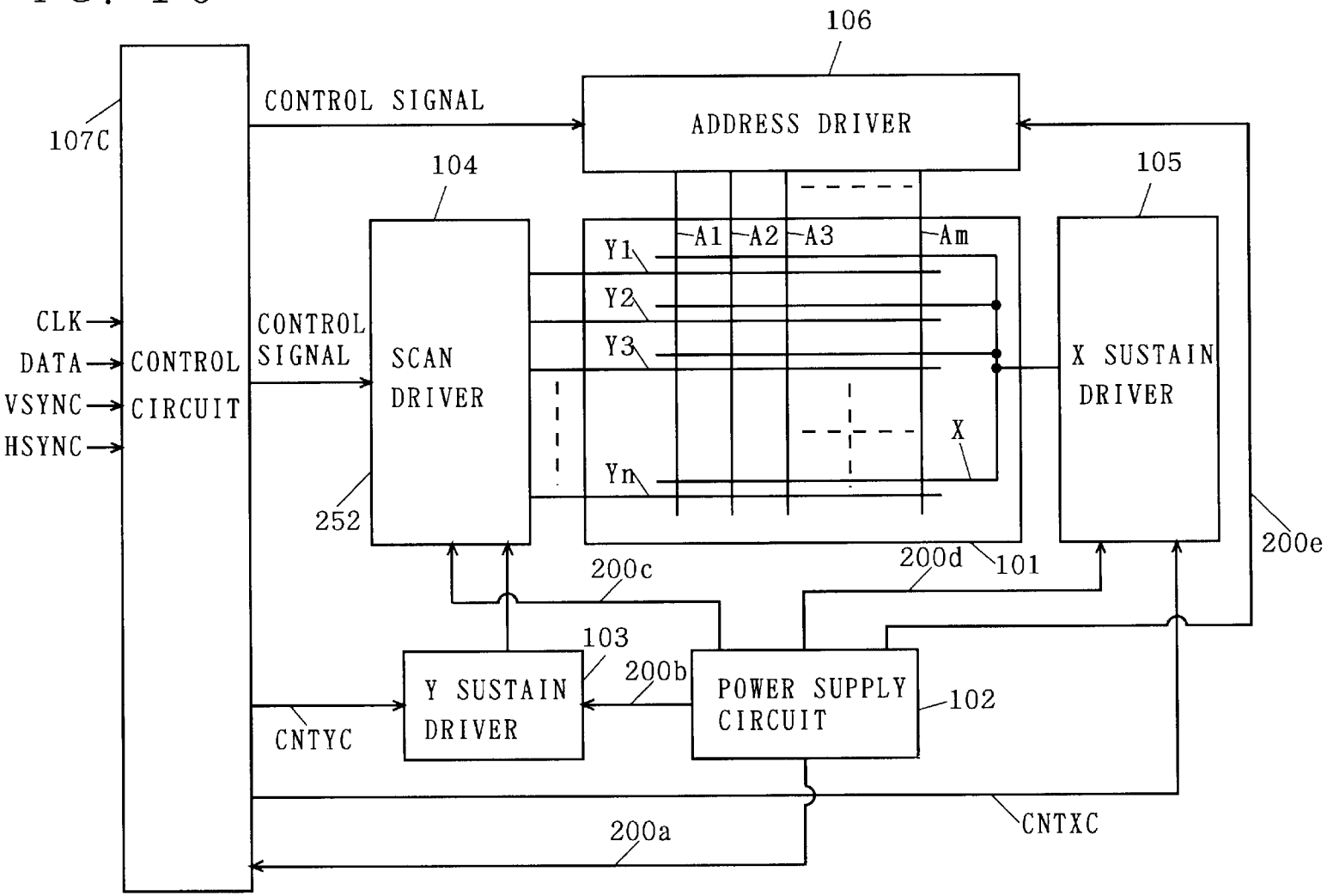
FIG. 16 is a block diagram showing the general construction of the plasma display device according to the third preferred embodiment.

FIG. 16 is a block diagram showing the general construction of the plasma display device according to the sixth preferred embodiment of the present invention, and corresponds to FIG. 26. The device of FIG. 16 differs in a control circuit 107C from the prior art circuit of FIG. 26. Specifically, the function of first and second control signals CNTXC and CNTYC outputted from the control circuit 107C to the X and Y sustain drivers 103 and 105, particularly the timing of the control signals for controlling the rising edge of the sustain pulses is fundamentally different from the rise timing of the control signals outputted from the prior art control circuit 107 of FIG. 26. Although the control circuits 107C and 107 significantly differ from each other in function, the control circuit 107C of the sixth preferred embodiment may be implemented by making a circuit modification permitted during general design to the control circuit 107 in terms of the circuit arrangement. In this sense, the sixth preferred embodiment is advantageous in readily implementing the novel control circuit 107C in the form of hardware or software while adding new functions to the control circuit 107C.

Particular circuit arrangements of the drivers 103, 104 and 105 of FIG. 16 correspond to the drivers 3, 31 and 2, respectively. Although the circuit arrangement and operation of the sustain driver for the electrodes X are shown in FIGS. 13, 14 and 15, the circuit arrangement and operation of the sustain diver for the electrodes Yi are similar to those for the electrodes X. The timing chart of FIGS. 28(*a*) through 28(*f*) may be utilized as a timing chart showing the general operation of the sixth preferred embodiment (that is, the output periods of the X and Y sustain pulses do not overlap on the time axis).

In the sixth preferred embodiment, both the values of the inductances $L_X$ and $L_Y$ shown in FIG. 1 are set to relatively high levels so that the voltage V1 to be reached by the panel voltage Vp determined in accordance with the setting of the Q-value of the series resonant LC circuit is higher than the firing voltage Vf and is as close as possible to the power supply voltage Vcc (the ideal voltage to be reached shown in FIGS. 30 and 31(*a*)). That is, the Q-value is set to a high level so that the relationship Vf<V1<Vcc holds. The above-mentioned problem encountered at this time is solved by closing the third switch S3 to clamp the rising panel voltage Vp at the power supply voltage Vcc at the time when the panel voltage Vp reaches the level V2 (V2<Vf and V2<V1) lower than the firing voltage Vf.

The Q-value may be set so that the relationship V1<Vf≦Vcc holds. This, however, does not contribute to the solution to the above-mentioned problem.

Operation will be described below.

Like reference numerals and characters are used to designate identical or corresponding elements, and the description thereof will be dispensed with.

State (1) (FIG. 13) (time between t0 and t2)

At time t0, when only a first switch element S1 is closed with second to fourth switch elements S2, S3 and S4 open, a charging current $i_L$ flows from a capacitor 10 charged up to a voltage Vss through an inductor 11 to a static capacitance element 12 between the electrodes X and Yi of the plasma display panel. At this time, the inductor 11 and the static capacitance element 12 form a series resonant LC circuit, and the panel voltage Vp starts rising toward the first level V1.

This operation is described in more detail. First, the current $i_L$ flowing through the inductor 11 gradually increases to store energy in the inductor 11. At time t1 when the panel voltage Vp reaches the voltage Vss, the current $i_L$ flowing through the inductor 11 reaches a maximum value $i_{L1}$, and the energy $E_L$ stored in the inductor 11 reaches a maximum value $\frac{1}{2}\times L\times i_{L1}^2$. Thereafter, the energy stored in the inductor 11 is emitted to the static capacitance element 12 serving as a panel capacitance to gradually decrease the current $i_L$ flowing through the inductor 11.

State (2)-A (FIG. 14) (time between t2 and t3)

The third switch element S3 (clamp switch) is closed in response to the third switch control signal to be described later before the panel voltage Vp reaches the first level V1, or at time t2 when the panel voltage Vp reaches the second level V2 (<Vf). The first switch element S1 remains closed. The current $i_L$ flowing through the inductor 11 is not yet equal to zero but continues flowing at time t2 when the third switch element S3 is closed. The current at this instance is assumed to have a value $i_{L2}$. Then, the inductor 11 still stores an energy of $\frac{1}{2}\times L\times i_{L2}^2$, and current continues flowing through the inductor 11 until the emission of the stored energy to the static capacitance element 12 is completed. Additionally, current is supplied also through the third switch element S3 which is closed. Specifically, the charging current is supplied to the panel capacitance 12 through a first current supply line L1 having a relatively high output impedance and a second current supply line L2 having a relatively low output impedance. In other words, as shown in FIG. 14, current is supplied in parallel through two paths: one through the inductor 11 and the other through the third switch element S3, during the time period of State (2)-A. The sixth preferred embodiment features the production of this state. This improves the power recovery efficiency over the prior art structure wherein current is supplied from an external power supply after the current supply from the inductor is stopped. Furthermore, since the output impedance in the circuit is low, discharge characteristics are not adversely affected even if a gas discharge occurs during the increase in the voltage Vp from the level V2 to the level V1.

State (2)-B (FIG. 15) (time t3 and later)

At and after time t3 when the energy stored in the inductor 11 is completely emitted to reach zero and the panel voltage Vp reaches the first level V1, current is supplied only through the third switch element S3, and the panel voltage Vp is held at the power supply voltage Vcc. Since a diode connected in series with the first switch element S1 blocks the current flowing from the power supply via the first switch element S1 to the capacitor 10, the first switch element S1 should be opened at any time during the time period of State (2)-B.

Since the second level V2 is relatively low as stated above, a gas discharge is not yet initiated during the time period of State (1) (time between t0 and t2). A gas discharge current flows during the time period of either State (2)-A (time between t2 and t3) or State (2)-B (time t3 and later). The third clamp switch S3 is closed during the time periods of States (2)-A and (2)-B, and the output impedance may be sufficiently lowered in the path of current flowing into the static capacitance element 12. Thus, if an abrupt gas discharge current flows, no or minimum reduction in the panel voltage Vp takes place. This eliminates the adverse effects upon the discharge characteristics of the plasma display panel while enhancing the reactive power recovery efficiency by increasing the Q-value.

The sixth preferred embodiment differs from the prior art technique in that the third clamp switch S3 is closed before the current $i_L$ flowing through the inductor 11 starts decreasing from its maximum level to reach zero, or during the time the current $i_L$ is decreasing. The effects provided by the sixth preferred embodiment are described below in conjunction with the prior art operation.

FIGS. 17(*a*) through 17(*d*) are a timing chart of first to fourth switch control signals VS1 to VS4 (generically referred to as the second control signal CNTYC) to be applied to the first to fourth switches S1 to S4. For comparison, a timing chart of first to fourth switch control signals VS1P to VSP in the case of FIG. 30 are shown in FIGS. 18(*a*) through 18(*d*).

i) FIGS. 12(*d*) and 12(*e*) show the prior art operation wherein the third clamp switch S3 is closed when $i_L=0$ in the conventional manner, with the Q-value of the resonant LC circuit as high as that shown in FIG. 12(*a*). In this case, the reactive power recovery efficiency may be increased. However, the gas discharge current flows in State (1) wherein current is supplied only from the inductor 11 in the resonant LC circuit. This decreases the panel voltage Vp, exerting the adverse effects upon the discharge characteristics of the plasma display panel as above described.

ii) FIGS. 12(*f*) and 12(*g*) show the prior art operation wherein the Q-value of the resonant LC circuit is reduced until the voltage to be reached in the resonant LC circuit does not exceed the firing voltage, or becomes about the second level V2, to overcome the problem described in i). In this case, no adverse effects are exerted upon the discharge characteristics, but the reactive power recovery efficiency is reduced to about V2/Vcc since current is supplied from the power supply after the completion of the current supply from the inductor.

A comparison will be made between the recovery efficiency in the case of FIGS. 12(*f*) and 12(*g*) and that of the sixth preferred embodiment shown in FIGS. 12(*a*), 12(*b*) and 12(*c*). Referring to FIG. 12(*f*), the current $i_L$ reaches zero when the panel voltage Vp reaches the second level V2. Thereafter, since no current is supplied from the inductor I1 to the panel, the current for raising the panel voltage Vp from the second level V2 to the power supply voltage Vcc is all supplied from the power supply at the voltage Vcc through the third clamp switch S3. In accordance with the sixth preferred embodiment shown in FIGS. 12(*a*) through 12(*c*), part of the current for raising the panel voltage Vp from the second level V2 to the power supply voltage Vcc is supplied from the inductor 11 (the shaded parts in the current waveforms of FIGS. 12(*a*), 12(*b*) and 12(*c*)). The current to be supplied from the power supply is accordingly reduced.

The broken curves of FIGS. 12(*a*) through 12(*c*) show the waveforms provided in the case of FIGS. 30, 31(*a*) and 31(*b*).

Since power consumption in the plasma display device is proportional to the total amount of current supplied from the power supply (time integral), the power consumption in the case of FIGS. 12(*a*) through 12(*c*) is less than that in the case of FIGS. 12(*f*) and 12(*g*). Thus, the reactive power recovery efficiency is higher in the case of FIGS. 12(*a*) through 12(*c*) than in the case of FIGS. 12(*f*) and 12(*g*).

Characteristics shown in FIGS. 12(*a*) through 12(*g*) are summarized in Table 1 for comparison.

TABLE 1

Figure 12A:
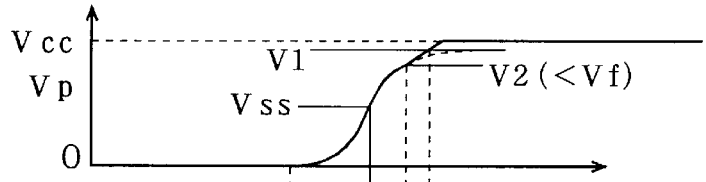
FIGS. 12(*a*) through 12(*c*) are waveform charts showing the process of charging a plasma display panel using LC resonance for illustrating the operation according to a sixth preferred embodiment of the present invention.
Figure 12B:
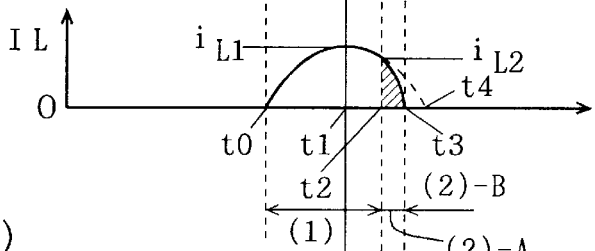
Figure 12C:
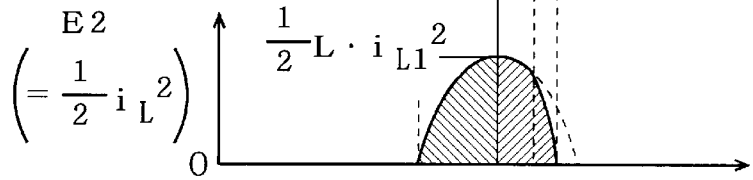
Figure 12D:
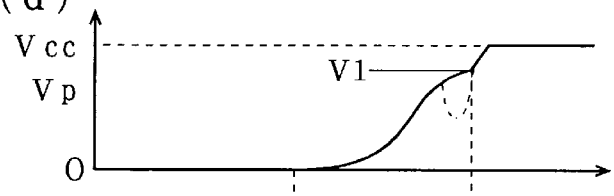
FIG. 12(d) (BACKGROUND ART)
Figure 12E:
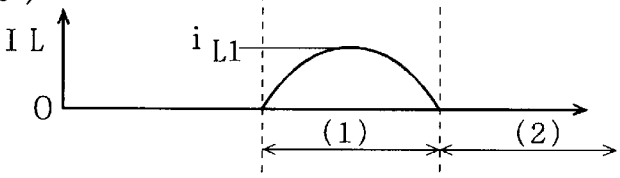
FIG. 12(e) (PRIOR ART)
Figure 12F:
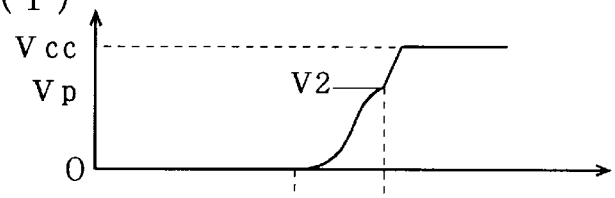
FIG. 12(f) (BACKGROUND ART)
Figure 12G:
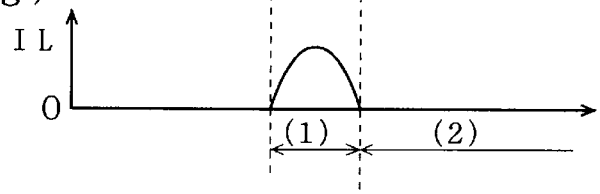
FIG. 12(g) (BACKGROUND ART)

| | FIGS. 12(a)–12(c) (sixth preferred embodiment) | FIGS. 12(d), 12(e) (prior art) | FIGS. 12(f), 12(g) (prior art) |
|---|---|---|---|
| Q-value of resonance | high | high | low |
| clamp voltage | V2 | V1 | V2 |
| adverse effects upon panel discharge characteristics | not exist | exist | not exist |
| reactive power recovery efficiency | medium | high | low |

The prior art technique shown in FIG. 12(*d*) provides the highest reactive power recovery efficiency but creates the adverse effects upon the discharge characteristics of the plasma display panel. Thus, the sixth preferred embodiment of the present invention shown in FIGS. 12(*a*) through 12(*c*) is more successful in that the reactive power recovery efficiency is held high without the adverse effects upon the discharge characteristics.

Further, the inductance L ($L_X$, $L_Y$,) of the inductor 11 should be set to a higher level in order to increase the Q-value of the resonant LC circuit for the purpose of further increasing the recovery efficiency. Closing the clamp switch (the third switch element S3 of FIG. 14) immediately before the panel voltage Vp reaches the firing voltage Vf prevents the adverse effects from being exerted upon the gas discharge even if the voltage rising rate at the rising edge is relatively low.

Moreover, if the rate of voltage change at the rising edge of the pulse indicative of the potential difference between the electrodes X and Yi where the gas discharge occurs (refer to FIGS. 3(*c*) and 3(*d*)) is increased using the methods described in the first to fifth preferred embodiments, or if the inductance $L_Y$ is decreased and the inductance $L_X$ is increased, then the firing voltage Vf is accordingly relatively increased (See FIG. 3(*c*)). Utilizing this, both the effects of the first and sixth preferred embodiments may be produced at a time. Specifically, the reactive power recovery efficiency may be further enhanced by using any one of modifications: (a) decreasing the inductance $L_X$ insofar as the relationship V1>Vf is satisfied, (b) increasing only the inductance $L_X$, with the inductance $L_Y$ unchanged, to increase the fall time of the potential difference (Yi−X), and (c) combining the modifications (a) and (b) together to change both of the inductances $L_X$ and $L_Y$.

Since the falling edge (at which no discharge is initiated) of the pulse exerts no effects on the discharge characteristics, the fourth clamp switch S4 should be closed after the current $i_L$ reaches zero. In this case, the relationship Vss=Vcc/2 does not hold because of the difference in timing conditions between the rising edge and falling edge of the pulse. The current to be finally reached by the voltage Vss is contemplated using the relationship Vss=Vcc/2 as initial conditions. Since the current flowing into the capacitor 10 at the falling edge of the pulse is greater than the current flowing out of the capacitor 10 at the rising edge of the pulse, the voltage Vss rises and then is stabilized at a level slightly higher than the voltage Vcc/2.

Seventh Preferred Embodiment

Figure 19:
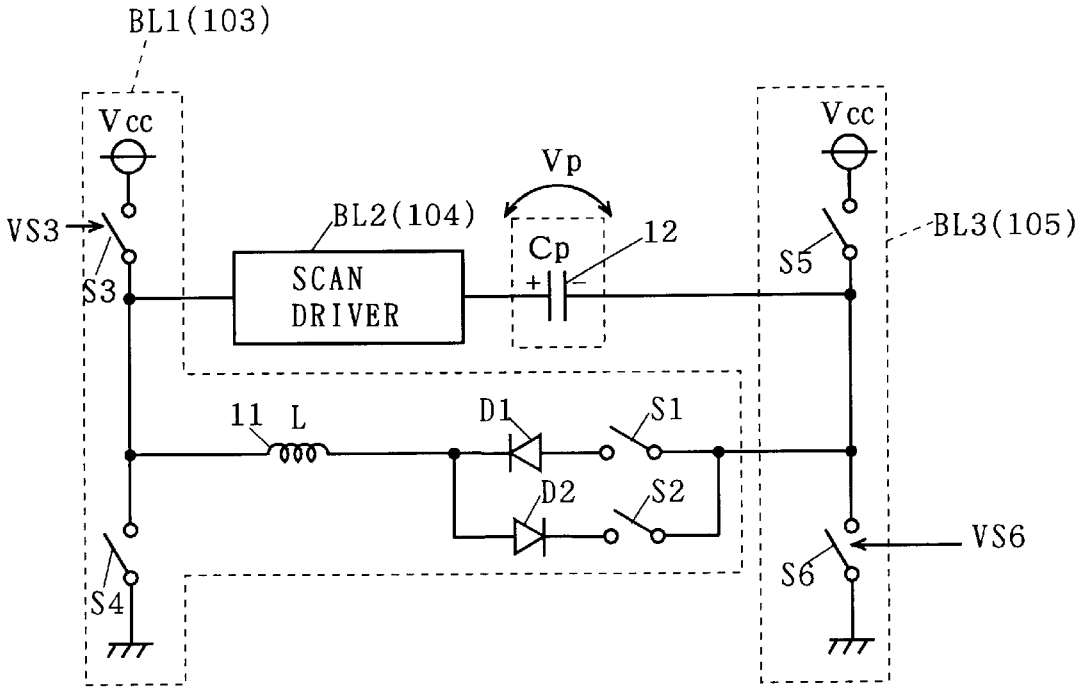
FIG. 19 is a circuit diagram of a drive circuit according to a seventh preferred embodiment of the present invention.
Figure 20:
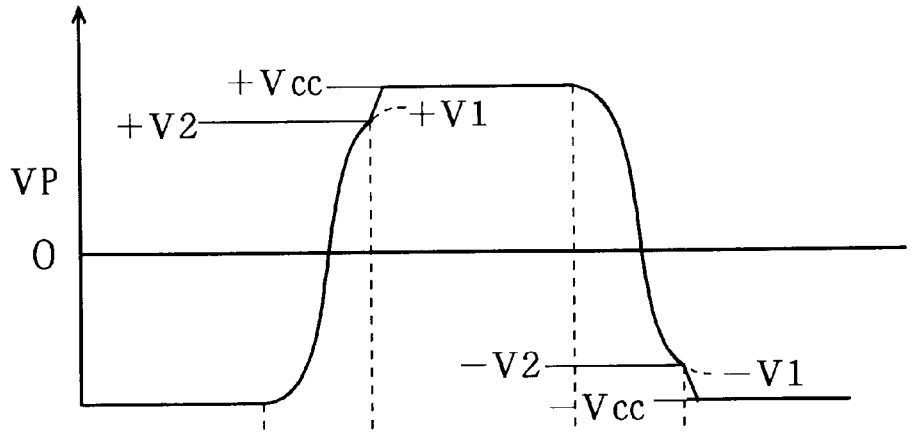
FIGS. 20(*a*) and 20(*b*) show voltage and current waveforms in the process of charging the plasma display panel using LC resonance for illustrating the operation according to the seventh preferred embodiment of the present invention.
Figure 20:
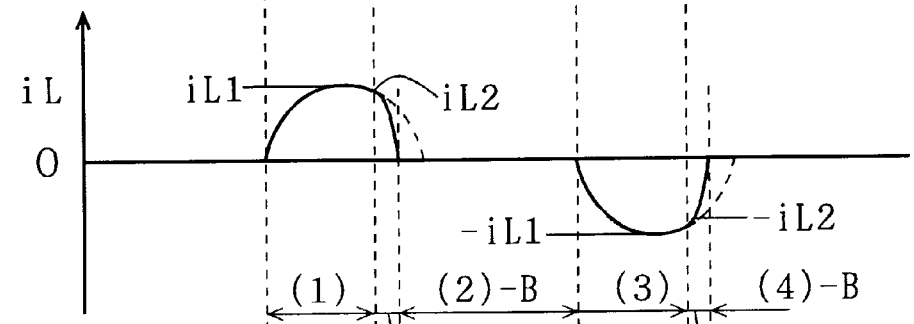
Figure 20:
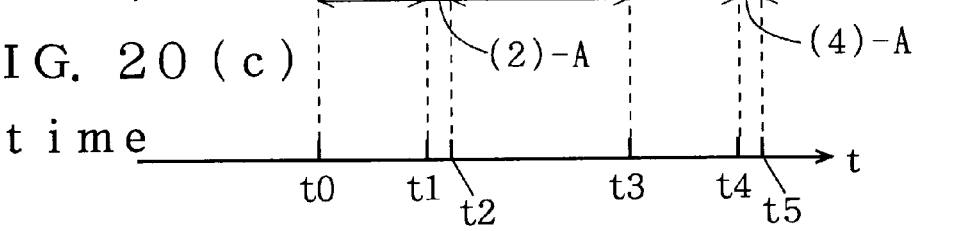
Figure 21:
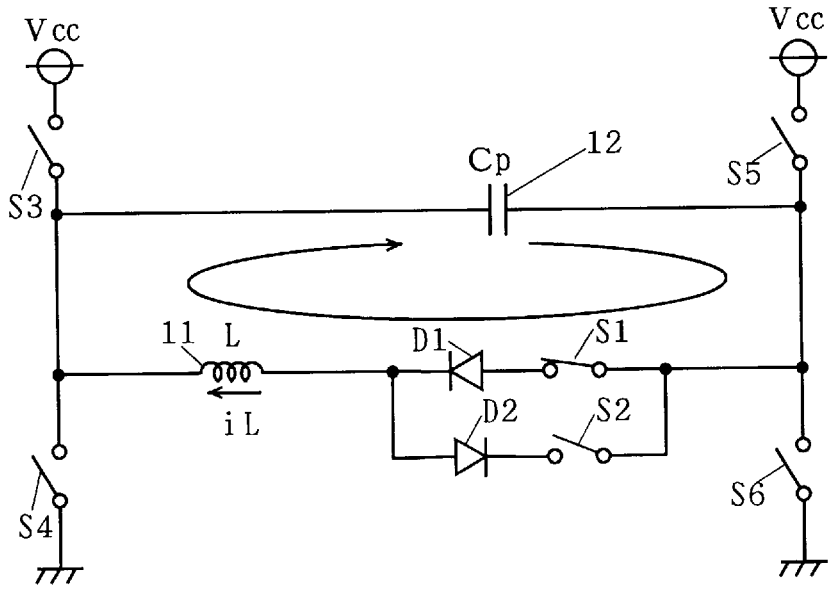
FIGS. 21, 22 and 23 illustrate current paths in the operation according to the seventh preferred embodiment of the present invention.
Figure 22:
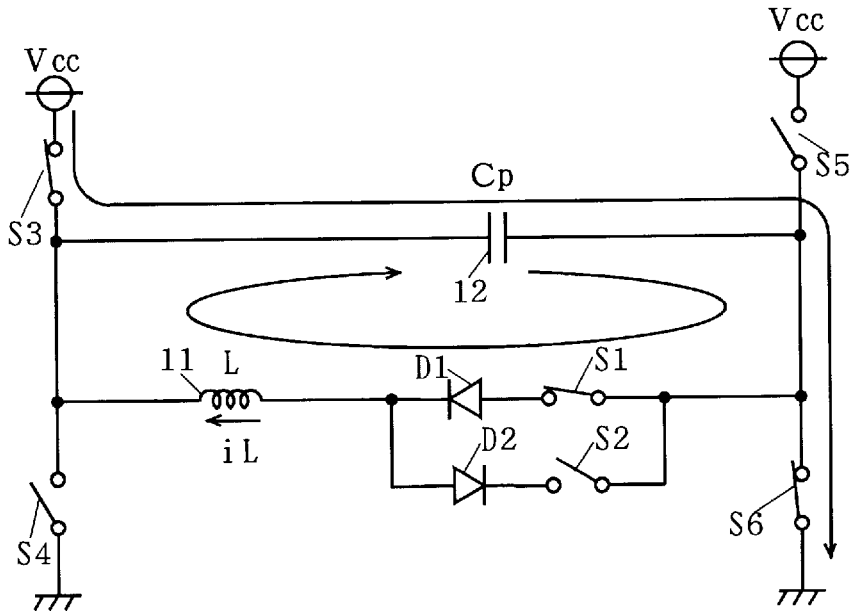
Figure 23:
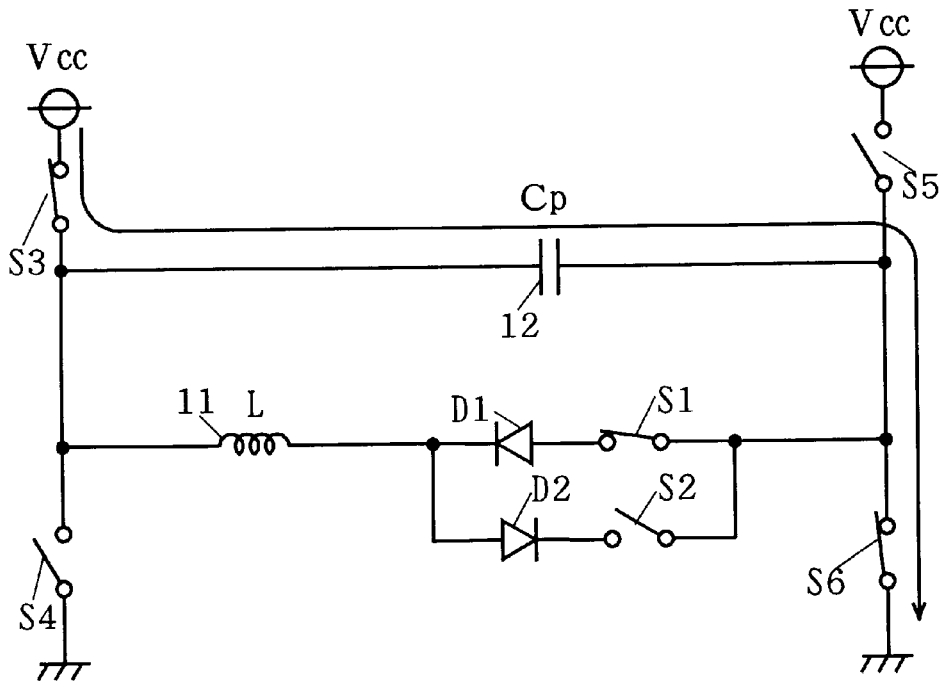

FIG. 19 shows a drive circuit according to a seventh preferred embodiment of the present invention. FIGS. 20(*a*) and 20(*b*) show voltage and current waveforms in the process of charging the plasma display panel using the LC resonance for illustration of the operation of the seventh preferred embodiment of the present invention. FIGS. 21, 22 and 23 are circuit diagrams for illustrating a current circuit in this operation.

Figure 24:
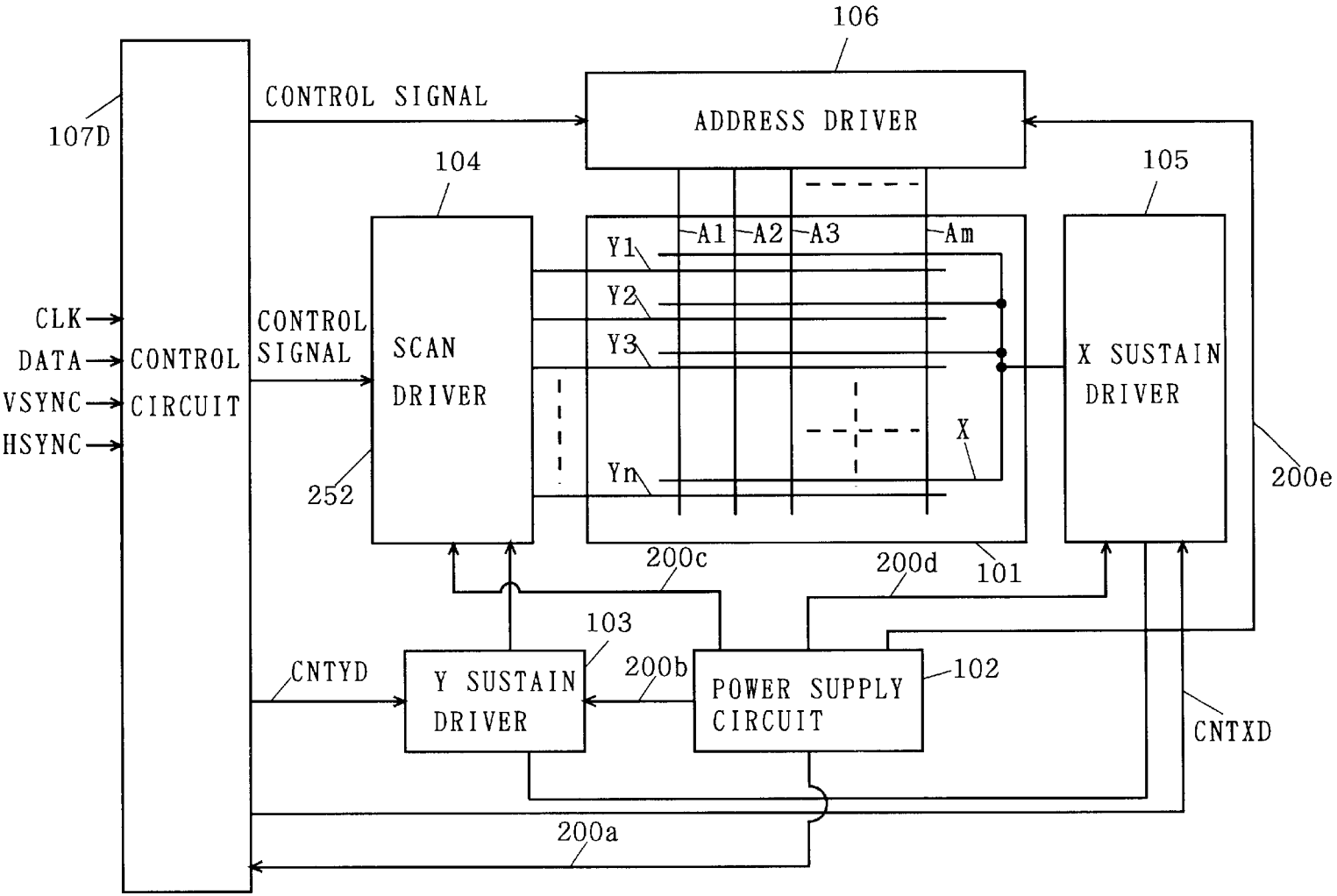
FIG. 24 is a block diagram showing the general construction of the plasma display device according to the seventh preferred embodiment of the present invention.
Figures 25, 25A, 25C, 25D, 25E:
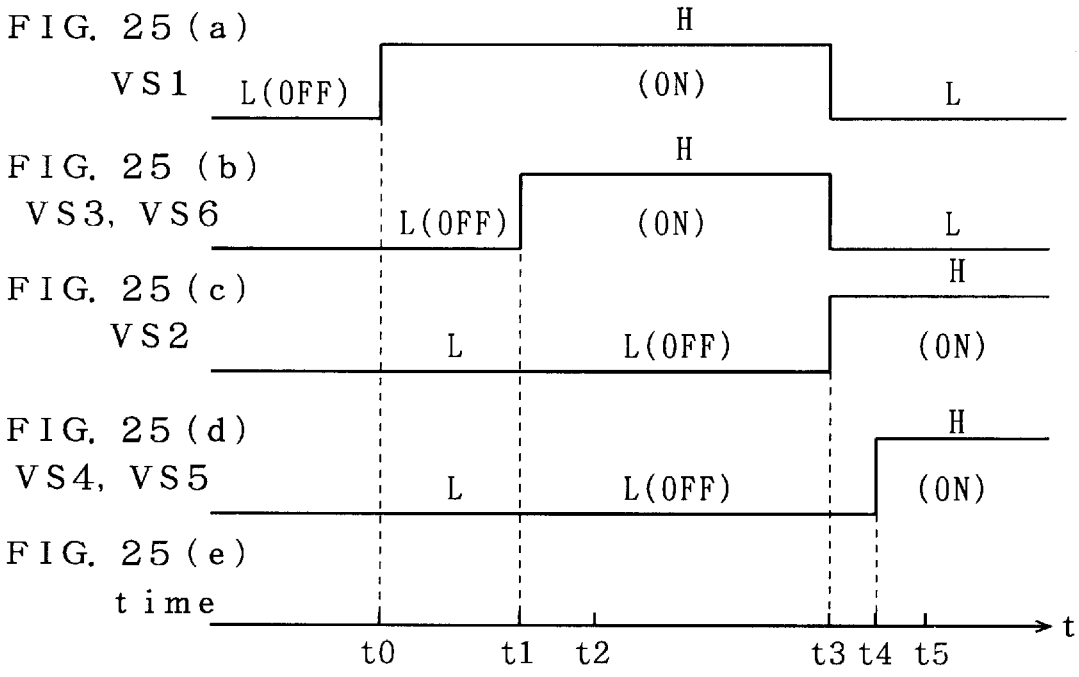
FIGS. 25(*a*) through 25(*e*) are a timing chart of the switch control signals according to the seventh preferred embodiment.

FIG. 24 is a block diagram showing the general construction of the plasma display device according to the seventh preferred embodiment. The seventh preferred embodiment features the timing of a second control signal CNTYD outputted from a control circuit 107D shown in FIG. 24 which corresponds to the second control signal CNTYC of FIG. 16. FIGS. 25(*a*) through 25(*e*) are a timing chart of the second control signal CNTYD. The control circuit 107D also has a novel function, but the circuit arrangement for implementing the control circuit 107D may be provided by modifying the circuit 107 of FIG. 26 within the range of general design variations.

The drivers 103, 104 and 105 of FIG. 24 correspond to blocks BL1 to BL3 of FIG. 19, respectively.

In FIG. 19, the reference numeral 12 designates a static capacitance element between the electrodes of the plasma display. The panel voltage Vp designates the potential difference between electrodes of the plasma display; here, the electrode potential on the right side of the figure is the basis and when the electrode on the left is a plus voltage, the panel voltage Vp is designated as a plus value. The reference numeral 11 designates an inductor; the reference character D designates a diode, and S1 to S6 designate switch elements. The switch elements S4 to S6 are clamp switches which can hold the voltage of respective electrodes of the panel at a level +Vcc and a ground level at low impedance. The switch elements S1 to S6 are controlled to be in the OFF state in response to an "L"-level control signal and in the ON state in response to an "H"-level control signal, and may be constructed using FETs.

The circuit arrangement shown in FIG. 19 is identical with that disclosed in Japanese Patent Application Laid-Open No. P08-152865A (1996) or in FIG. 5 of European Patent Application Publication No. EP0704834A1. The seventh preferred embodiment makes improvements in operation so as to prevent the adverse effects from being exerted on the gas discharge of the plasma display panel by switching ON the clamp switches before the gas discharge is initiated in the plasma display as in the sixth preferred embodiment.

Operation is described below.

State (1) (FIG. 21)

With the panel capacitance 12 charged to a voltage −Vcc, the switch elements S2 to S6 are opened and the switch element S1 is closed. Then, electric charges accumulated in the static capacitance element 12 are discharged through the inductor 11.

At this time, the panel capacitance 12 and the inductor 11 form a series resonant LC circuit, and the panel voltage Vp starts rising toward a voltage +V1 to be reached which is determined by the Q-value. Ideally, V1=Vcc. In practice, the voltage V1 is slightly lower than the power supply voltage Vcc (V1<Vcc) because of the resistance elements present in the resonant circuit.

This operation is described in more detail. First, the current $i_L$ flowing through the inductor 11 gradually increases to store energy in the inductor 11. When the panel voltage Vp reaches 0V, the current $i_L$ reaches the maximum value $i_{L1}$, and the energy stored in the inductor 11 reaches the maximum value $\frac{1}{2}\times L\times i_{L1}^2$. Thereafter, the energy stored in the inductor 11 is emitted to the static capacitance element 12 to gradually decrease the current $i_L$.

State (2)-A (FIG. 22)

The switch elements S3 and S6 are closed when the panel voltage Vp reaches the second level V2 before the panel voltage Vp reaches the voltage V1 to be reached. The first switch element S1 remains closed. The current $i_L$ is not yet 0 A when both the switch elements S3 and S6 are closed. The current at this instance is assumed to have the value $i_{L2}$. Then, the inductor 11 still stores an energy of $\frac{1}{2}\times L\times i_{L2}^2$, and current continues flowing through the inductor 11 until the emission of the stored energy to the static capacitance element 12 is completed. Additionally, current is supplied also through the switch elements S3 and S6 which are closed.

Thus, as shown in FIG. 22, current is supplied in parallel through two paths: one through the inductor 11 and the other through the switch elements S3 and S6, during the time period of State (2)-A.

State (2)-B (FIG. 23)

After the energy stored in the inductor 11 is completely emitted to reach zero, current is supplied only by the path through the switch elements S3 and S6, and the panel voltage Vp is held at the sustain pulse voltage +Vcc. Since the diode connected in series with the switch element S1 blocks the current flowing from the power supply via the switch element S1 to the ground, the switch element S1 should be opened at any time during the time period of State (2)-B.

State (3) to State (4)-B (not shown)

Operations similar to those in State (1) to State (2)-B are performed with the polarity reversed.

Since the second level V2 is relatively low (V2<Vf and V2<V1), a gas discharge is not yet initiated during the time period of State (1). The gas discharge current flows during the time period of either State (2)-A or State (2)-B. The clamp switches S3 and S6 are closed during the time periods of States (2)-A and (2)-B, and the output impedance may be sufficiently lowered in the path of current flowing into the static capacitance element 12. Thus, if an abrupt gas discharge current flows, no or minimum reduction in the panel voltage Vp takes place. This eliminates the adverse effects upon the gas discharge characteristics of the plasma display panel.

While the invention has been described in detail, the foregoing description is in all aspects illustrative and not restrictive. It is understood that numerous other modifications and variations can be devised without departing from the scope of the invention.

I claim:

1. A method of driving a plasma display panel having first and second electrodes at least one of which is covered with a dielectric, said plasma display panel repeatedly producing a gas discharge in response to a pulse voltage of alternately changed polarities applied between said first and second electrodes, said method comprising the steps of:

(a) charging a static capacitance element between said first and second electrodes through an inductor and storing energy in said inductor until the magnitude of current flowing through said inductor reaches a maximum value;

(b) emitting said energy stored in said inductor toward said static capacitance element; and (c) charging said static capacitance element at a low impedance through a path which does not include said inductor in the course of the emission of said energy stored in said inductor toward said static capacitance element in addition to the emission, to supply a voltage corresponding to said pulse voltage to said static capacitance element, wherein the inductance value of said inductor is set so that a voltage-to-be-reached of said static capacitance element which is determined by a Q-value of a resonant LC circuit comprised of said inductor and said static capacitance element is higher than a gas discharge starting voltage and close to said pulse voltage if said static capacitance element is charged from said inductor but not through said path, and wherein said gas discharge starting voltage is a minimum voltage to be applied to said static capacitance element for production of said gas discharge.

2. The method according to claim 1, wherein switching from said step (b) to said step (c) is performed before said gas discharge is produced between said first and second electrodes.

3. The method according to claim 2, wherein said switching from said step (b) to said step (c) is performed before a potential difference between said first and second electrodes reaches said gas discharge starting voltage.

4. A plasma display device comprising:

a plasma display panel comprising first and second electrodes at least one of which is covered with a dielectric, said plasma display panel repeatedly producing a gas discharge in response to a pulse voltage applied between said first and second electrodes; and a drive circuit applying said pulse voltage between said first and second electrodes to drive said plasma display panel, said pulse voltage being of alternately changed polarities, said drive circuit comprising:

(a) a power supply having said pulse voltage as a power supply voltage;

(b) a switch element connected between at least said power supply and one electrode of said first and second electrodes;

(c) an electric charge source; and (d) an inductor comprising a first end connected to said electric charge source, and a second end connected to said one electrode, said inductor and a static capacitance element between said first and second electrodes constituting a resonant LC circuit, wherein said inductor stores energy therein until the magnitude of current flowing through said inductor reaches a maximum value while charging said static capacitance element with electric charges supplied from said electric charge source, and subsequently emits said energy toward said static capacitance element, thereby charging said static capacitance element, wherein said switch element allows continuity between said power supply and said one electrode when a voltage applied to said static capacitance element reaches a second level, wherein relationships (said second level)<(a gas discharge starting voltage) and (said second level)<(a first level) <(said pulse voltage) hold, and wherein said first level is a voltage-to-be-reached of said static capacitance element which is determined by a Q-value of said resonant LC circuit if said switch element is non-conducting, and said gas discharge starting voltage is a minimum voltage to be applied to said static capacitance element for production of said gas discharge.

5. The plasma display device according to claim 4, wherein said electric charge source comprises:

a capacitor charged with a voltage that is approximately one-half said pulse voltage.

6. The plasma display device according to claim 4, wherein said electric charge source comprises:

a diode comprising an anode connected to the other electrode of said first and second electrodes, and a cathode connected to said inductor.

7. A plasma display device comprising:

an AC plasma display panel comprising first and second electrodes at least one of which is covered with a dielectric;

a first pulse generating circuit applying a first sustain pulse to said first electrode;

a second pulse generating circuit applying a second sustain pulse to said second electrode; and a control circuit controlling said first and second pulse generating circuits so that a first output time period of said first sustain pulse and a second output time period of said second sustain pulse partially overlap each other, wherein said first output time period is defined by the time when said first sustain pulse starts rising and the time when said first sustain pulse finishes falling, wherein said second output time period is defined by the time when said second sustain pulse starts rising and the time when said second sustain pulse finishes falling, and wherein one of said first and second pulse generating circuits which applies one of said first and second sustain pulses which rises earlier generates a pulse having a higher rate of voltage change at its rising edge and a higher rate of voltage change at its falling edge than does the other of said first and second pulse generating circuits.

8. The plasma display device according to claim 7, wherein each of said first and second pulse generating circuits comprises a power recovery portion comprising at least an inductor, and wherein the inductor of said one of said first and second pulse generating circuits that generates said pulse having the higher rate of voltage change at its rising edge has a lower inductance value than does the inductor of the other of said first and second pulse generating circuits.

9. The plasma display device according to claim 7, wherein each of said first and second pulse generating circuits comprises a switch element for pulse generation, and wherein the switch element of said one of said first and second pulse generating circuits that generates said pulse having the higher rate of voltage change at its rising edge has a higher switching rate and a higher on-resistance than does the switch element of the other of said first and second pulse generating circuits.

10. The plasma display device according to claim 9, wherein the switch element of said one of said first and second pulse generating circuits that generates said pulse having the higher rate of voltage change at its rising edge is a field effect transistor, and the switch element of the other of said first and second pulse generating circuits is a junction bulk transistor.

11. The plasma display device according to claim 7, wherein said first pulse generating circuit comprises:

a wall charge polarity adjusting pulse generating portion generating and outputting a pulse for inverting the polarity of a wall charge generated immediately after a gas discharge sustain operation is completed.

12. The plasma display device according to claim 7, wherein said second pulse generating circuit comprises:

a wall charge polarity adjusting pulse generating portion generating and outputting a pulse for inverting the polarity of a wall charge generated immediately after a gas discharge sustain operation is completed.

* * * * *